US008805265B2

(12) United States Patent
Fujisawa et al.

(10) Patent No.: US 8,805,265 B2
(45) Date of Patent: Aug. 12, 2014

(54) DEVELOPER TRANSPORT DEVICE AND IMAGE FORMING APPARATUS

(71) Applicant: Fuji Xerox Co., Ltd., Tokyo (JP)

(72) Inventors: Yuichi Fujisawa, Kanagawa (JP); Tatsuya Soga, Kanagawa (JP); Yoshiyuki Takashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 90 days.

(21) Appl. No.: 13/672,145

(22) Filed: Nov. 8, 2012

(65) Prior Publication Data

US 2013/0287462 A1 Oct. 31, 2013

(30) Foreign Application Priority Data

Apr. 26, 2012 (JP) ..... 2012-101883

(51) Int. Cl.
*G03G 21/00* (2006.01)

(52) U.S. Cl.
USPC ..... 399/358; 399/359

(58) Field of Classification Search
CPC ..... G03G 21/105; G03G 2221/0005; G03G 15/0891; B41J 2/16535; B41J 2/16538
See application file for complete search history.

(56) References Cited

U.S. PATENT DOCUMENTS 6,266,511 B1 7/2001 Murakami et al.

FOREIGN PATENT DOCUMENTS

JP A-2000-284660 10/2000
JP A-2007-86815 4/2007

*Primary Examiner* — Walter L Lindsay, Jr.
*Assistant Examiner* — Arlene Heredia Ocasio
(74) *Attorney, Agent, or Firm* — Oliff PLC

(57) ABSTRACT

Disclosed is a developer transport device including a recovery chamber where a developer is recovered, an accommodation chamber that accommodates the developer, a transport unit that transports the developer into the accommodation chamber by rotation, a hollow guiding path that guides the developer in the recovery chamber into the accommodation chamber, and a transport assisting member disposed inside the hollow guiding path and deformed and restored by rotation of the transport unit to assist transport of the developer. The transport assisting member includes a first part extending along an inner wall of the hollow guiding path from a discharge port of the recovery chamber to a position for contact with the transport unit, and a second part intersecting with a front surface of the first part and extending from an intermediate position of the first part to a position for contact with the transport unit.

20 Claims, 23 Drawing Sheets

DEVELOPER TRANSPORT DEVICE AND IMAGE FORMING APPARATUS

CROSS-REFERENCE TO RELATED APPLICATIONS

This application is based on and claims priority under 35 USC 119 from Japanese Patent Application No. 2012-101883 filed Apr. 26, 2012.

BACKGROUND (i) Technical Field

The present invention relates to a developer transport device and an image forming apparatus.

(ii) Related Art

As an image forming apparatus that forms an image, such as a copier, a printer, a facsimile or a multifunction printer having a combination of these functions, an image forming apparatus that forms an image using electrophotography has been proposed.

In this electrophotographic image forming apparatus, a toner is supplied from a developing device to an electrostatic latent image formed by irradiation of a laser beam onto the surface of a photoconductor drum to form a toner image, the toner image on the surface of the photoconductor drum is transferred onto a sheet or the like, and the sheet is sent to a fixing unit to fix the toner image on the sheet. The toner that remains on the surface of the photoconductor drum after transfer of the toner image is recovered in a cleaning process and is transported to the developing device by a transport device for recycling.

SUMMARY

According to an aspect of the invention, there is provided a developer transport device including: a recovery chamber where a developer from an image holding member after transfer is recovered; an accommodation chamber that is disposed under the recovery chamber and accommodates the developer; a transport unit that transports the developer into the accommodation chamber by rotation; a hollow guiding path that is formed in a hollow shape to connect a discharge port of the recovery chamber and an accommodation port of the accommodation chamber to guide the developer in the recovery chamber into the accommodation chamber; and a transport assisting member that is disposed inside the hollow guiding path and is deformed and restored by rotation of the transport unit to assist transport of the developer inside the hollow guiding path, wherein the transport assisting member includes a first part that extends along an inner wall surface of the hollow guiding path from the side of the discharge port of the recovery chamber to a position where the first part is in contact with the transport unit, and a second part that is disposed to intersect with a front surface of the first part extending along the inner wall surface of the hollow guiding path and extends from an intermediate position of the first part in a length direction to a position where the second part is in contact with the transport unit.

BRIEF DESCRIPTION OF THE DRAWINGS

Exemplary embodiments of the present invention will be described in detail based on the following figures, wherein.

DETAILED DESCRIPTION

Figure 1:
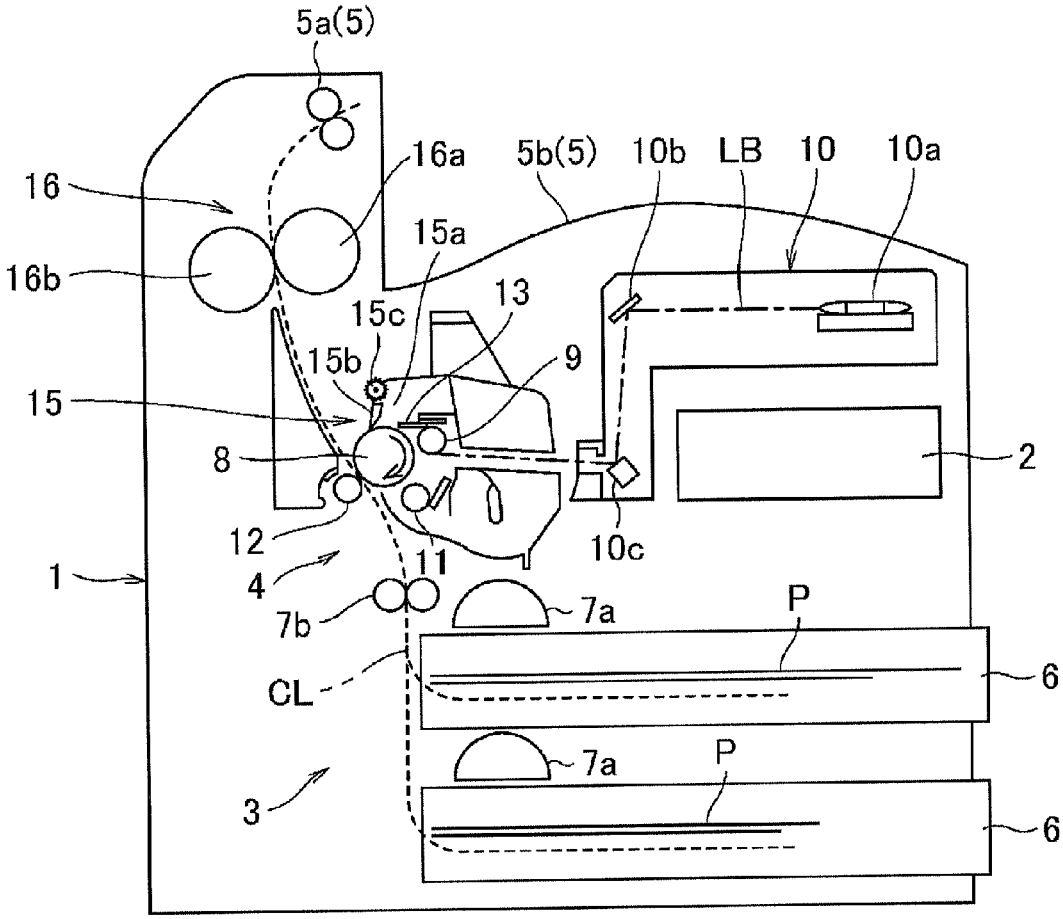
FIG. 1 is a drawing schematically illustrating an image forming apparatus according to an exemplary embodiment of the invention.

Hereinafter, exemplary embodiments will be described in detail with reference to the accompanying drawings as an example of the invention. In the following drawings for description of the exemplary embodiments, the same reference numerals are basically given to the same components, and repetitive description thereof will be omitted.

Figure 2:
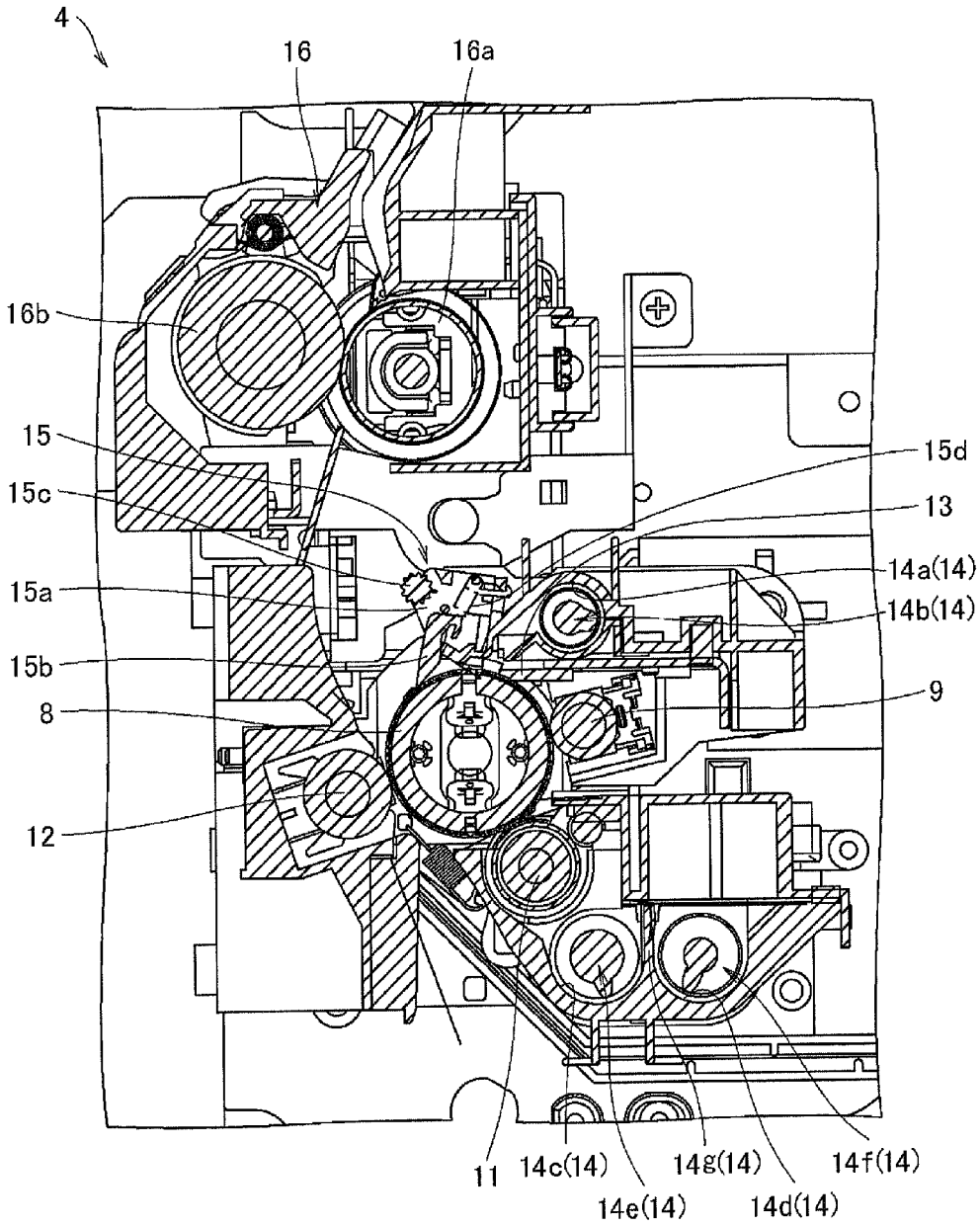
FIG. 2 is an enlarged cross-sectional view illustrating main parts of an image forming unit of the image forming apparatus in FIG. 1.

FIG. 1 is a drawing schematically illustrating an image forming apparatus 1 according to an exemplary embodiment of the invention, and FIG. 2 is an enlarged cross-sectional view illustrating main parts of an image forming unit of the image forming apparatus 1 in FIG. 1.

The image forming apparatus 1 such as a copier, a printer, a facsimile or a multifunction printer having a combination of these functions has a function of printing an image on a sheet (an example of a recording medium) P, and includes an image processing unit 2, a paper feeding unit 3, an image forming mechanism unit 4, and a paper discharge unit 5.

The image processing unit 2 is a circuit unit that performs predetermined image processing such as A/D conversion, density correction and shading correction for image information input from the outside. To the image processing unit 2, for example, image information transmitted from a host computer such as a personal computer, image information transmitted through a communication line such as a LAN (Local Area Network), a telephone line or the internet, or image information read by an image reading device are input.

The paper feeding unit 3 has a function of supplying a sheet P to the image forming mechanism unit 4, and includes plural sheet cassettes 6, feed rollers 7*a* and a pair of registration rollers 7*b*. A broken line CL in FIG. 1 represents a transport path of the sheet P.

Plural sheets P of different types in, for example, paper size, thickness or quality are accommodated in the respective sheet cassettes 6. The sheet P in any one of the plural sheet cassettes 6 is extracted by the feed roller 7*a* one by one, is sent to the pair of registration rollers 7*b* through the transport path CL, and is sent to the image forming mechanism unit 4 according to a transfer timing of a toner image.

The image forming mechanism unit 4 has a function of printing an image on the sheet P sent from the paper feeding unit 3 using electrophotography on the basis of the image information transmitted from the image processing unit 2, and includes a photoconductor drum (an example of an image holding member) 8, a charging roller 9, an exposure unit 10, a developing roller (an example of developing means) 11, a transfer roller (an example of transfer means) 12, a cleaner blade (an example of cleaning means) 13, a developer transport device 14 (see FIG. 2), a paper detachment member 15, and a fixing unit (an example of fixing means) 16. Here, the photoconductor drum 8, the charging roller 9, the developing roller 11, the cleaner blade 13, the developer transport device 14, and the paper detachment member 15 form a configuration that are integrally handled as an image forming body.

The photoconductor drum 8 is formed by providing a photosensitive layer made of an organic photo-conductor (OPC), amorphous silicon or the like on an outer circumferential surface of a conductive cylindrical drum base made of aluminum, for example, and is supported to be rotatable in the clockwise direction as indicated by an arrow.

The charging roller 9 has a function of charging the surface of the photoconductor drum 8 with a predetermined polarity and electric potential as a charging bias voltage is applied, and is disposed in the vicinity of the photoconductor drum 8.

The exposure unit 10 has a function of performing exposure by irradiation of a laser beam LB onto the surface of the photoconductor drum 8 charged by the charging roller 9 and removing electric charges in an exposed portion to form an electrostatic latent image, and includes a laser oscillator (not shown), a rotating polygon mirror 10*a*, and reflecting mirrors 10*b* and 10*c*. The laser oscillator is a light source of the laser beam LB and is controlled to be turned on and off on the basis of the image information transmitted from the image processing unit 2. The laser beam LB emitted from the laser oscillator is deflected for scanning by the rotating polygon mirror 10*a*, and is irradiated onto the surface of the photoconductor drum 8 through the reflecting mirrors 10*b* and 10*c*.

The developing roller 11 has a function of assigning a developer to the electrostatic latent image on the surface of the photoconductor drum 8 for development, and is installed to be rotatable in the counterclockwise direction on a downstream side with reference to the charging roller 9 in the rotating direction of the photoconductor drum 8, in the vicinity of the photoconductor drum 8. As a developing bias voltage is applied to the developing roller 11, the developer is attached to the electrostatic latent image on the surface of the photoconductor drum 8 and is developed as a developed image.

The transfer roller 12 has a function of transferring the developer image formed on the surface of the photoconductor drum 8 onto the sheet P, and is installed on a downstream side with reference to the developing roller 11 in the rotating direction of the photoconductor drum 8, so as to be in contact with the photoconductor drum 8. As a transfer bias voltage having a polarity opposite to the polarity of the developer image on the surface of the photoconductor drum 8 is applied to the transfer roller 12, the developer image on the surface of the photoconductor drum 8 is transferred to the sheet P. A position where the photoconductor drum 8 and the transfer roller 12 face each other corresponds to a transfer position.

The cleaner blade 13 is a member that removes the developer that remains on the surface of the photoconductor drum 8 after the transfer process to clean the surface of the photoconductor drum 8. The remaining developer removed and recovered by the cleaner blade 13 is recovered into a recovery chamber 14*a* of the developer transport device 14.

The developer transport device 14 is a device that transports the remaining developer recovered in the recovery chamber 14*a* to the developing roller 11. The recovery chamber 14*a* of the developer transport device 14 is disposed at a position laterally shifted from above the photoconductor drum 8. A discharge port (described later) is formed in a lower surface of one end side of the recovery chamber 14*a* in the length direction. Further, a transport member 14*b* that transports the remaining developer is disposed to be rotatable inside the recovery chamber 14*a*.

Further, accommodation chambers 14*c* and 14*d* of the developer transport device 14 are disposed to be adjacent to each other at a position laterally shifted from under the photoconductor drum 8. Here, an accommodation port is formed in an upper surface of one end side of the accommodation chamber 14*c* in the length direction under the discharge port of the recovery chamber 14*a*. Further, inside each of the accommodation chambers 14*c* and 14*d*, transport members (an example of transport means) 14*e* and 14*f* that transport the remaining developer are disposed to be rotatable. The accommodation chambers 14*c* and 14*d* are separated by a partition wall 14*g* disposed in a neighboring space therebetween, and are connected with each other through passages formed on opposite sides of the partition wall 14*g* in the length direction.

The paper detachment member 15 is disposed on a side that faces a side of the sheet P on which the developer image is transferred between the transfer position where the developer image on the photoconductor drum 8 is transferred by the transfer roller 12 and the fixing unit 16, and is disposed at two positions spaced from each other along the axial direction of the photoconductor drum 8 so as to stably cope with the sheet P having a type (size) and a transport direction (longitudinal direction or transverse direction) corresponding to the image forming apparatus 1. Here, the number of the sheet detachment members 15 is not limited thereto, and may be three or more. Each sheet detachment member 15 includes a support 15*a*, a detachment claw 15*b* and a wheel 15*c*.

The fixing unit 16 has a function of applying heat and pressure to the sheet P on which the developer image is transferred to fix the developer image to the sheet P, and includes a heating roller 16*a*, and a pressing roller 16*b* that presses the sheet P to the heating roller 16*a*. The sheet P on which the developer image is fixed by the fixing unit 16 is discharged onto a discharge tray 5*b* of the discharge unit 5 by a pair of discharge rollers 5*a* of the discharge unit 5.

Figure 3:
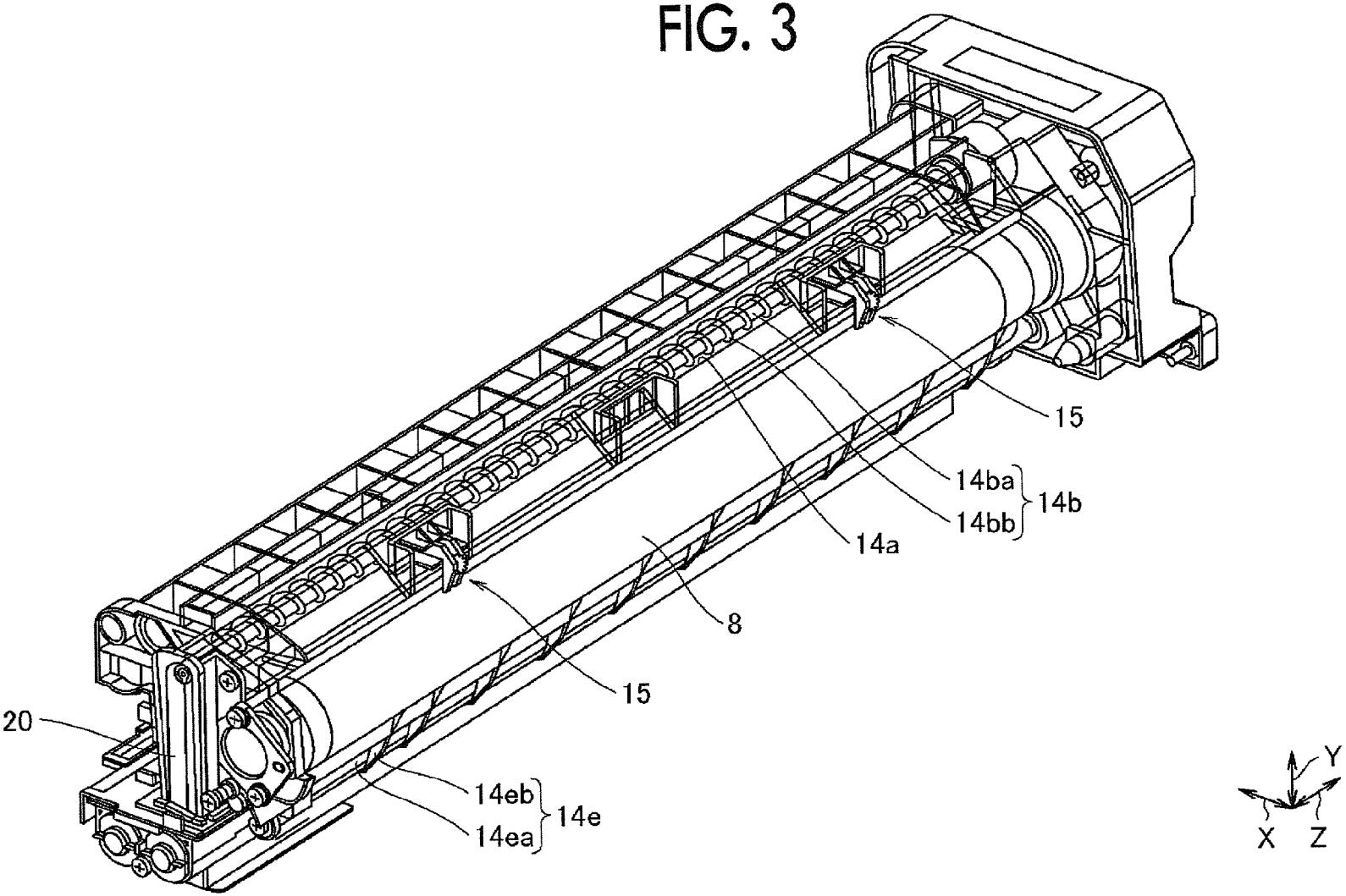
FIG. 3 is an overall perspective view illustrating an image forming body that forms the image forming apparatus in FIG. 1.
Figure 6:
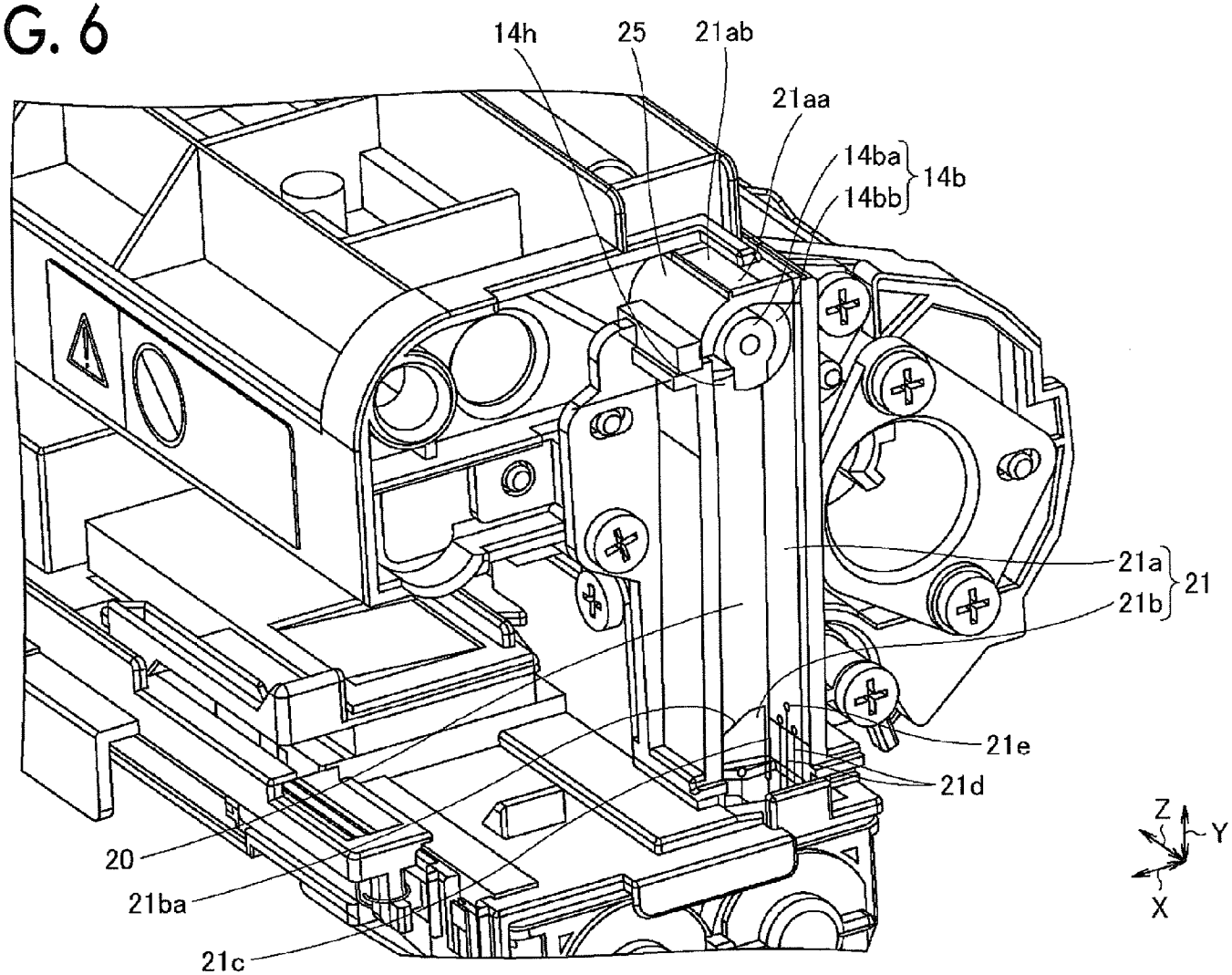
FIG. 6 is an enlarged perspective view illustrating the main parts of the image forming body in FIG. 3.
Figure 7:
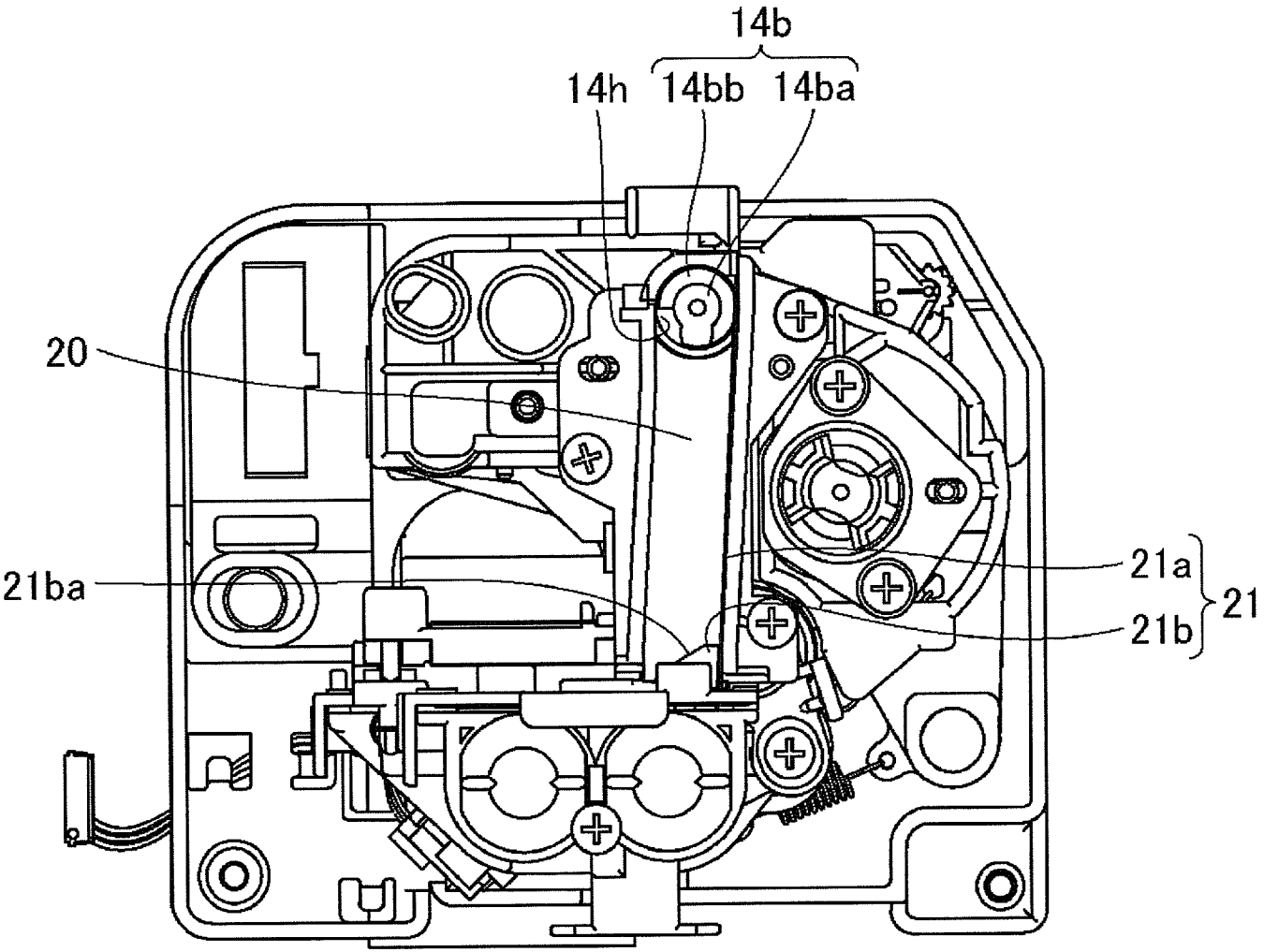
FIG. 7 is a front view illustrating one end surface of the image forming body in FIG. 3.
Figure 8:
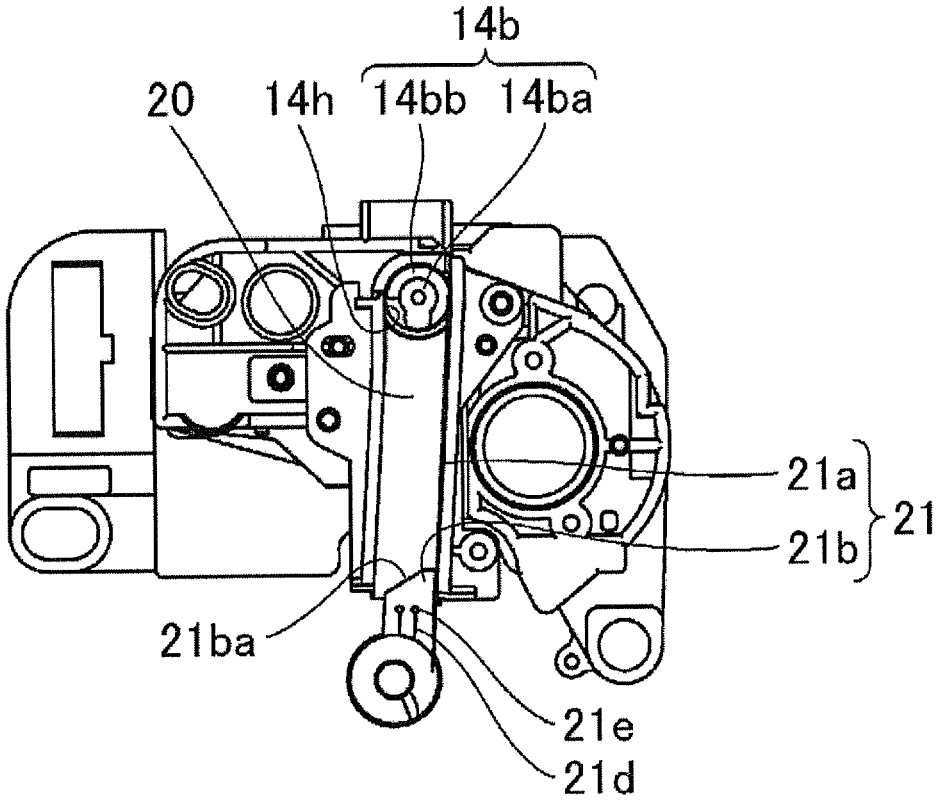
FIG. 8 is a front view illustrating the image forming body in FIG. 7 with a part thereof being removed.
Figure 9:
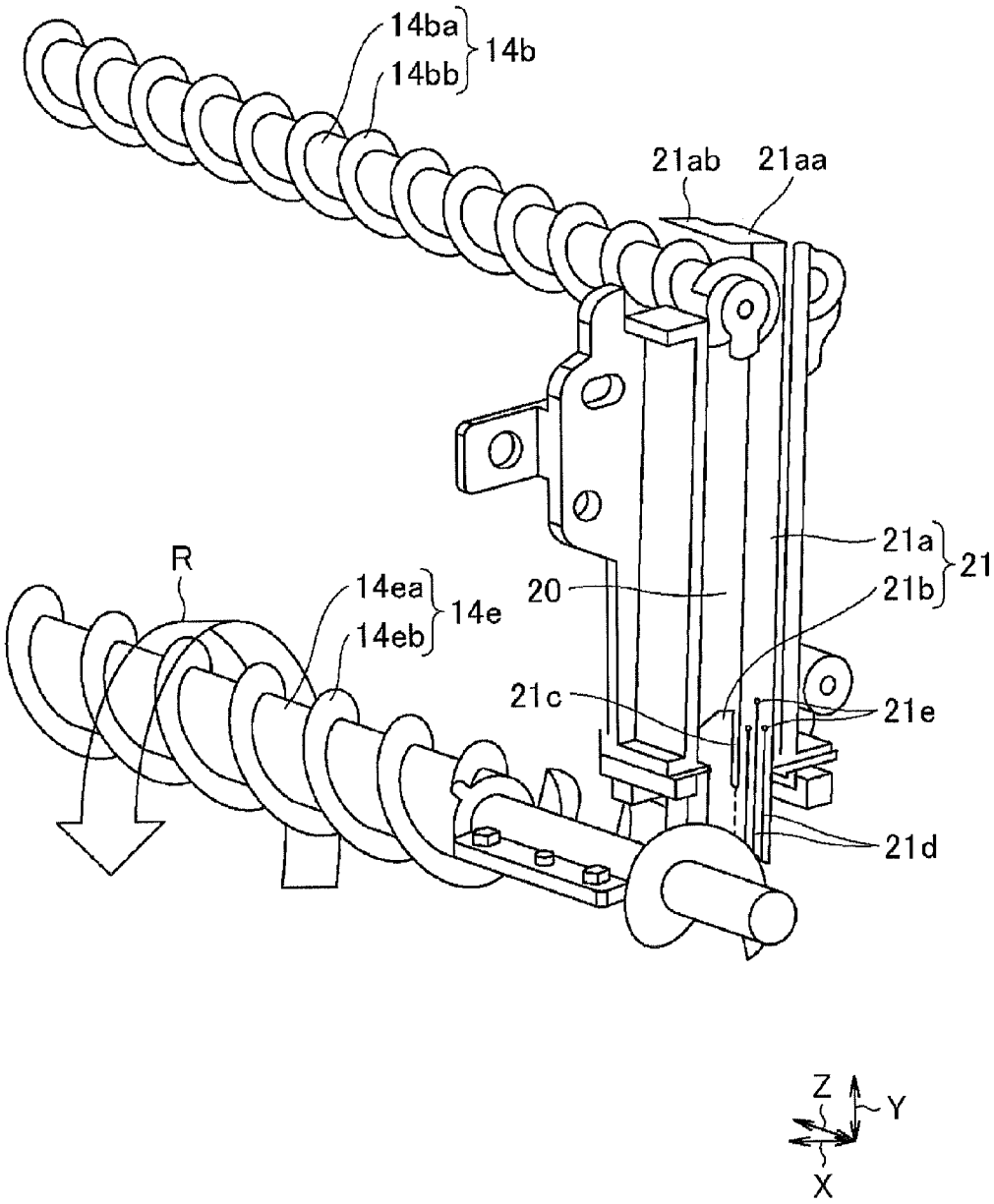
FIG. 9 is an extracted perspective view illustrating main parts of a developer transport device of the image forming body in FIG. 3.
Figure 10:
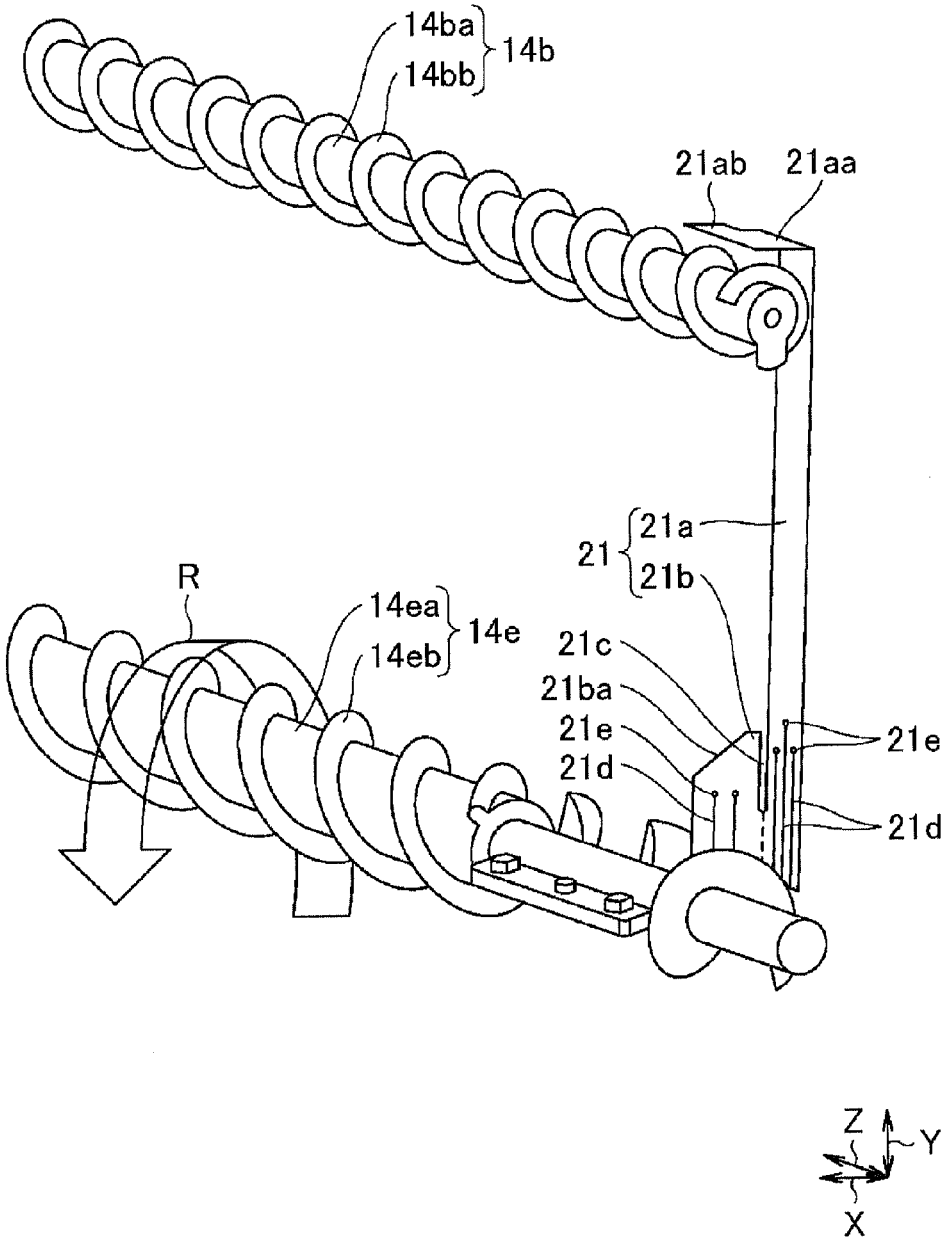
FIG. 10 is an extracted perspective view illustrating main parts of the developer transport device of the image forming body in FIG. 3.
Figure 11:
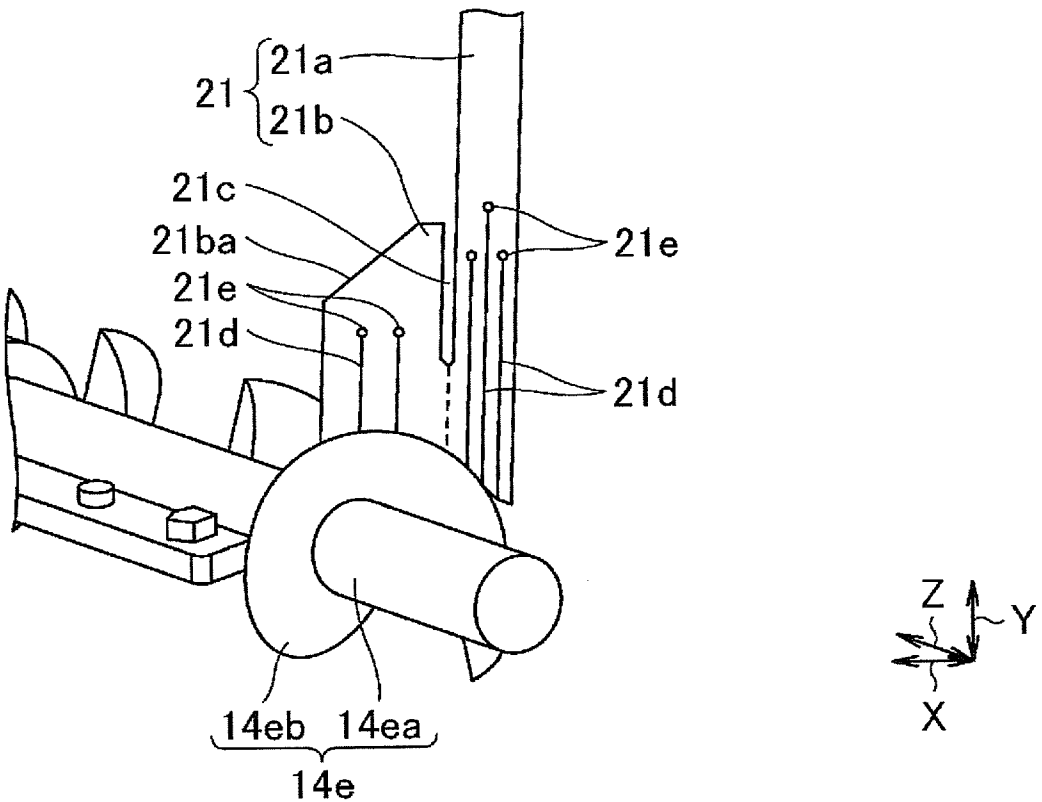
FIG. 11 is an enlarged perspective view illustrating a lower portion of the developer transport device in FIG. 10.
Figure 12:
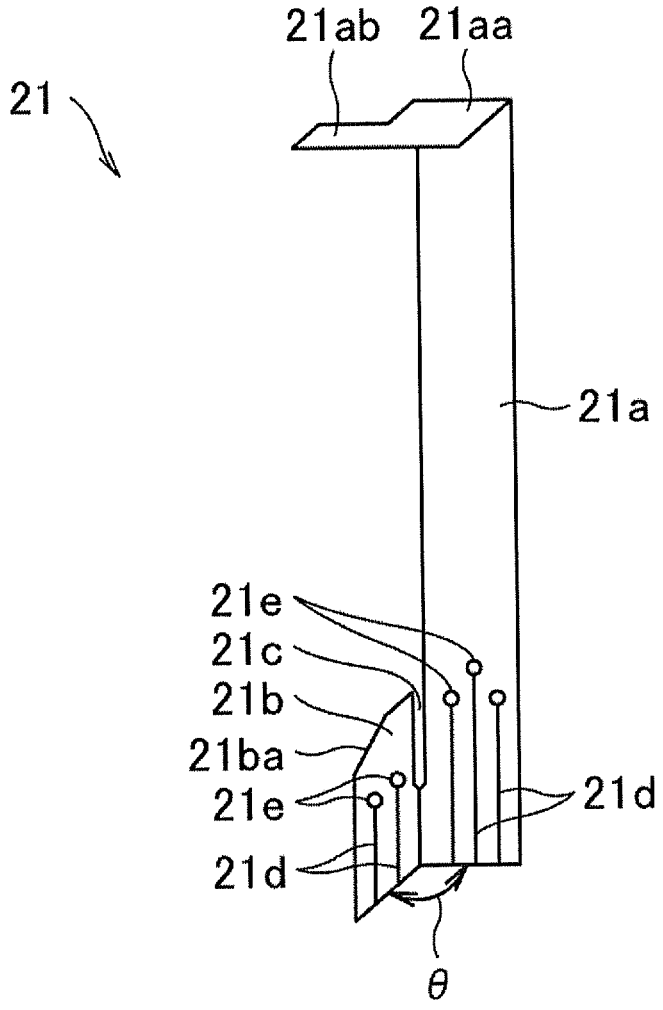
FIG. 12 is an overall perspective view illustrating a transport assisting member of the developer transport device in FIG. 9.
Figure 13:
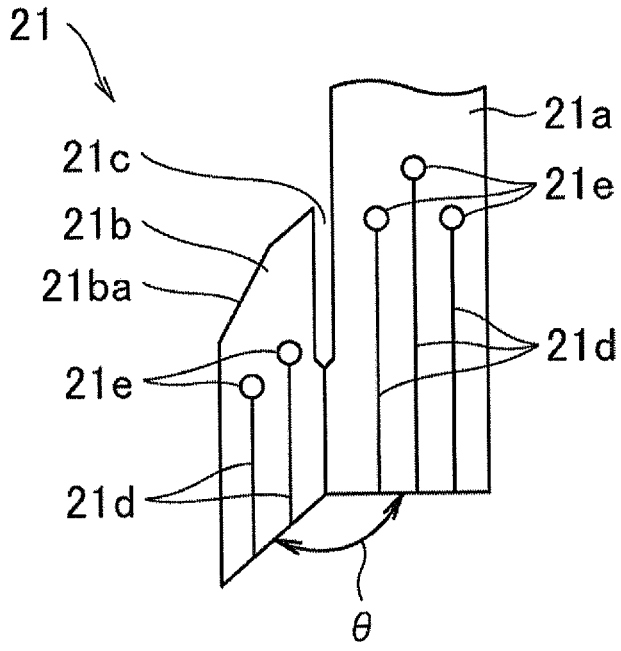
FIG. 13 is an enlarged perspective view illustrating a lower portion of the transport assisting member in FIG. 12.
Figure 14:
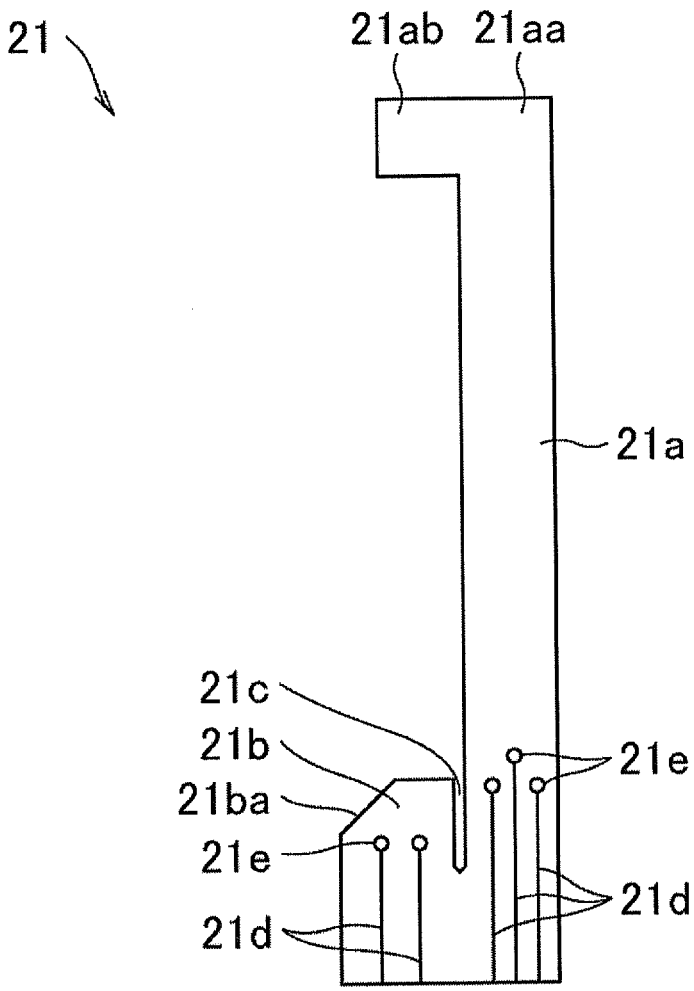
FIG. 14 is a plan view illustrating the transport assisting member in FIG. 12 before being folded.

Next, a configuration of the developer transport device 14 of the image forming apparatus 1 will be described with reference to FIGS. 2 to 14. FIG. 3 is an overall perspective view illustrating the image forming body described above, FIGS. 4 to 6 are enlarged perspective views illustrating main parts of the image forming body in FIG. 3, FIG. 7 is a front view illustrating one end surface of the image forming body in FIG. 3, FIG. 8 is a front view illustrating the image forming body in FIG. 7 with a part thereof being removed, FIGS. 9 and 10 are extracted perspective views illustrating main parts of the developer transport device 14 of the image forming body in FIG. 3, FIG. 11 is an enlarged perspective view illustrating a lower portion of the developer transport device 14 in FIG. 10, FIG. 12 is an overall perspective view illustrating a transport assisting member of the developer transport device 14 in FIG. 9, FIG. 13 is an enlarged perspective view illustrating a lower portion of the transport assisting member in FIG. 12, and FIG. 14 is a plan view illustrating the transport assisting member in FIG. 12 before being folded.

Figure 4:
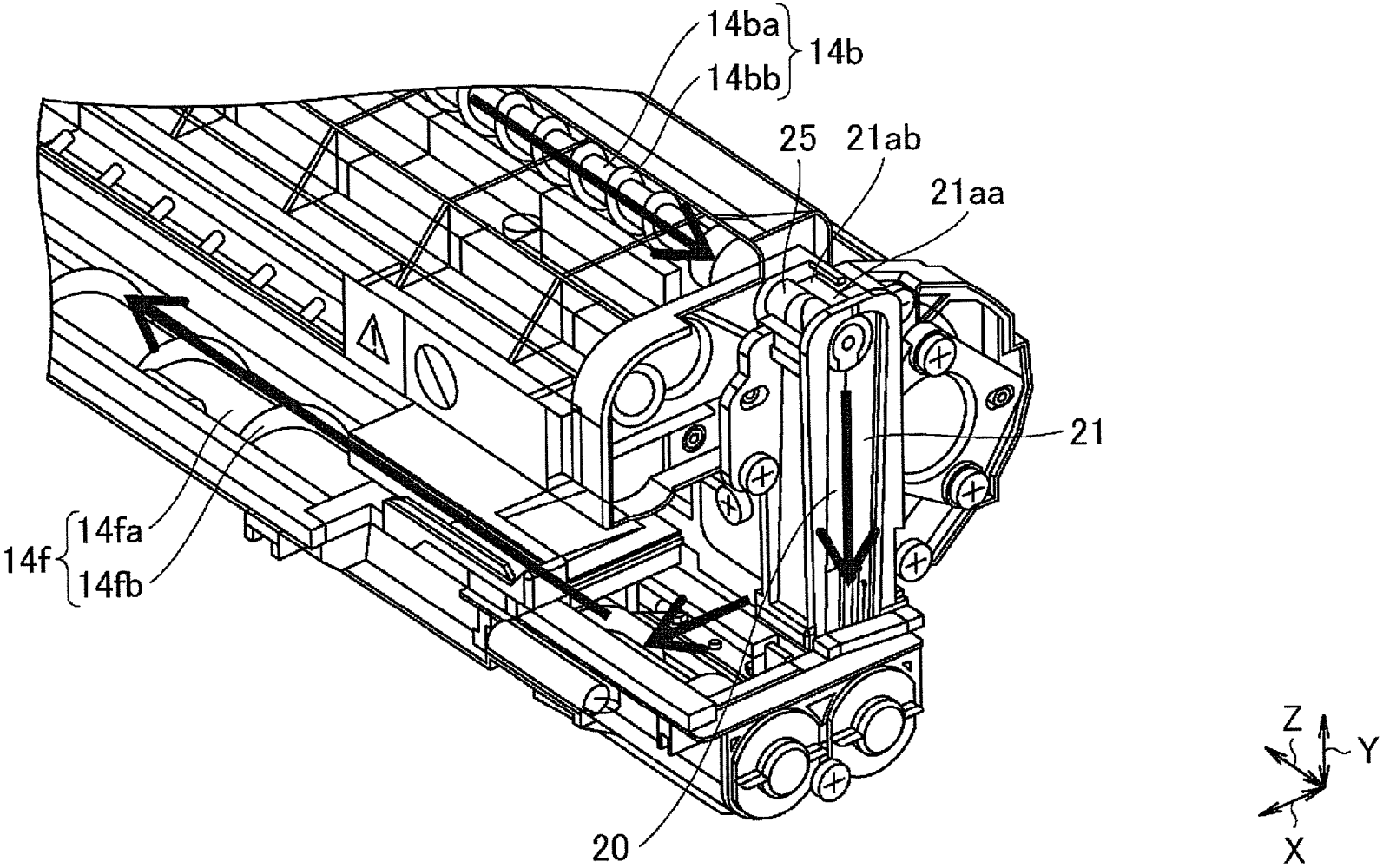
FIG. 4 is an enlarged perspective view illustrating main parts of the image forming body in FIG. 3.
Figure 5:
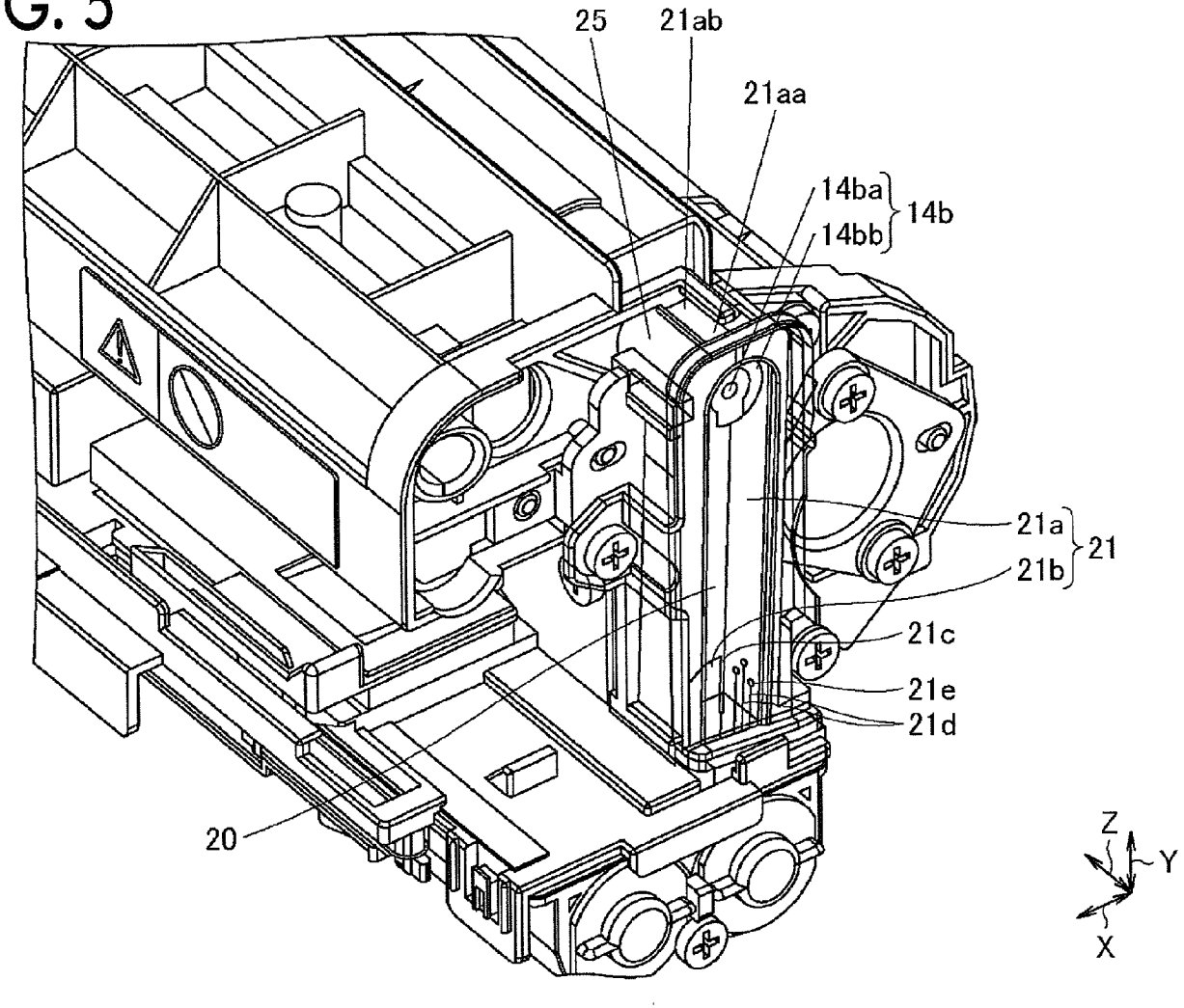
FIG. 5 is an enlarged perspective view illustrating the main parts of the image forming body in FIG. 3.

FIGS. 3 to 5 show the image forming body with the inside thereof being partially looked through for ease of description. Further, FIG. 6 shows the inside of a guide tube of the image forming body with a front surface wall of the hollow guide tube being removed for simplicity. Further, FIGS. 3 to 6, and FIGS. 9 to 11 show X, Y and Z axes that are orthogonal to each other for understanding the position relationship or direction in the respective drawings.

As shown in FIG. 3, the recovery chamber 14*a* of the developer transport device 14 is disposed in a state of being extended along the entire region of the photoconductor drum 8 in the axial direction (length direction: Z axis direction). In a lower surface of one end side of the recovery chamber 14*a* in the length direction (Z axis direction), a discharge port 14*h* (see FIGS. 6 and 7) of the remaining developer is formed.

Further, as shown in FIGS. 3 and 4, and FIGS. 9 and 10, the transport member 14*b* in the recovery chamber 14*a* includes a rotating shaft 14*ba* that extends along the entire region of the recovery chamber 14*a* in the length direction (Z axis direction), and a spiral blade 14*bb* that is disposed in a spiral shape on the outer circumference of the rotating shaft 14*ba*. The remaining developer recovered in the recovery chamber 14*a* is transported to the discharge port 14*h* by rotation of the transport member 14*b*.

On the other hand, the accommodation chambers 14*c* and 14*d* (see FIG. 2) of the developer transport device 14 are disposed in a state of being extended along the entire region of the photoconductor drum 8 in the length direction (length direction: Z axis direction). Here, in the upper surface of one end side of the accommodation chamber 14*c* in the length direction (Z axis direction), the above-mentioned accommodation port (not shown) of the remaining developer is formed under the above-mentioned discharge port 14*h*.

Further, as shown in FIG. 3 and FIGS. 9 to 11, the transport member 14*e* in the accommodation chamber 14*c* includes a rotating shaft 14*ea* that extends along the entire region of the accommodation chamber 14*c* in the length direction (Z axis direction), and a spiral blade 14*eb* that is provided in a spiral shape on the outer circumference of the rotating shaft 14*ea*. The remaining developer accommodated in the accommodation chamber 14*c* is transported by rotation of the transport member 14*e*.

As shown in FIG. 4, the transport member 14*f* in the accommodation chamber 14*d* includes a rotating shaft 14*fa* that extends along the entire region of the accommodation chamber 14*d* in the length direction (Z axis direction), and a spiral blade 14*fb* that is provided in a spiral shape on the outer circumference of the rotating shaft 14*fa*. The remaining developer recovered in the accommodation chamber 14*d* is transported by rotation of the transport member 14*f*.

As shown in FIGS. 3 to 9, the discharge port 14*h* of the recovery chamber 14*a* disposed on the upper side and the accommodation port of the accommodation chamber 14*c* disposed on the lower side are connected to each other through the guide tube (an example of a hollow guiding path) 20. Accordingly, the remaining developer recovered in the recovery chamber 14*a* is transported as indicated by an arrow in FIG. 4.

That is, the remaining developer recovered in the recovery chamber 14*a* is transported to the discharge port 14*h* by rotation of the transport member 14*b*, and then, naturally drops from the guide tube 20 to be accommodated in the accommodation chamber 14*c* (see FIG. 2). The remaining developer accommodated in the accommodation chamber 14*c* is transported to the adjacent accommodation chamber 14*d* (see FIG. 2), and is transported to the other end side of the accommodation chamber 14*d* in the length direction by rotation of the transport member 14*f*. The remaining developer transported to the other end side of the accommodation chamber 14*d* in the length direction is transported to the adjacent accommodation chamber 14*c* through the passage, and returns to the developing roller 11 while being transported toward the front side in FIG. 4 from the other end side of the accommodation chamber 14*c* in the length direction by rotation of the transport member 14*e*.

As shown in FIGS. 4 to 6, the guide tube 20 is a hollow tube having a rectangular opening shape, and the transport assisting member 21 that assists transport (drop) of the remaining developer so that the guide tube 20 is not clogged by the remaining developer is provided in the guide tube 20.

As shown in FIGS. 5 to 14, in the transport assisting member 21, a first part 21*a* having a relatively long thin plate shape and a second part 21*b* having a relatively short thin plate shape are integrally formed by being folded at a boundary therebetween to intersect with each other. Here, the cross-sectional shape of the lower portion of the transport assisting member 21 in the width direction is an L shape, for example.

The first part 21*a* of the transport assisting member 21 extends along an inner wall surface of the guide tube 20 from the side of the discharge port 14*h* of the recovery chamber 14*a* to a position where the first part 21*a* is in contact with the transport member 14*e* in the accommodation chamber 14*c*. The first part 21*a* is disposed so that its front surface faces the side of the hollow transport path of the guide tube 20 and its rear surface on the rear side of the front surface faces the side of the inner wall surface of the guide tube 20. An upper portion 21*aa* of the first part 21*a* is disposed outside the guide tube 20, and is fixed to a casing 25. This configuration will be described in more detail later.

On the other hand, the second part 21*b* of the transport assisting member 21 is a part folded in an intersecting direction with respect to the front surface of the first part 21*a*, and extends from an intermediate position of the first part 21*a* in the length direction to a position where the second part 21*b* is in contact with the transport member 14*e* in the accommodation chamber 14*c*. The transport assisting member 21 is disposed in the guide tube 20 in a state where the first part 21*a* is disposed along the axial direction (length direction: Z axis direction) of the transport member 14*e* and the second part

21*b* is disposed to intersect with the axial direction (length direction: Z axis direction) of the transport member 14*e*.

The transport assisting member 21 (the first part 21*a* and the second part 21*b*) is made of transparent synthetic resin such as polyethylene terephtalate (hereinafter, simply referred to as PET), for example, and has a configuration of being returned to the original shape although bent or twisted due to an external force. By using PET as a material that forms the transport assisting member 21, it is possible to achieve high thermal resistance, cold resistance, abrasive resistance, durability and chemical resistance at low prices. Here, the material that forms the transport assisting member 21 is not limited to PET as long as stiffness and elasticity are achieved, and for example, synthetic resin such as polyimide resin may be used.

The transport assisting member 21 (the first part 21*a* and the second part 21*b*) is configured to repeat deformation and restoration by rotation of the transport member 14*e*. Due to the deformation and restoration movement of the transport assisting member 21, clogging of the remaining developer in the guide tube 20 is prevented. That is, as shown in FIGS. 9 to 11, if the transport member 14*e* rotates in an arrow direction R (see FIGS. 9 and 10), the spiral blade 14*eb* is in contact with the first part 21*a* and the second part 21*b* of the transport assisting member 21. Then, the first part 21*a* and the second part 21*b* are subject to a force in the rotating axis direction (Z axis direction), and the second part 21*b* is gradually lifted upward, and thus, the first part 21*a* is twisted while being bent in the thickness direction (X axis direction) over the entire length. Thereafter, if the transport member 14*e* further rotates and the spiral blade 14*eb* moves in the axial direction (Z axis direction), the spiral blade 14*eb* is deviated from the first part 21*a* and the second part 21*b*, and thus, the first part 21*a* and the second part 21*b* are returned to the original shape while being resiliently vibrated. Due to such a deformation and restoration movement of the transport assisting member 21, the remaining developer in the guide tube 20 is collapsed to prevent clogging.

Here, even in a case where the transport assisting member having only the first part 21*a* without the second part 21*b* is provided, there is an effect of reducing generation of clogging of the remaining developer. However, since the first part 21*a* receives only a force in the width direction (Z axis direction) and the first part 21*a* is bent or resiliently vibrated only in the lower portion of the first part 21*a* (in the vicinity of the accommodation port of the accommodation chamber 14*c*), an effect of collapsing clogging of the remaining developer is not sufficiently achieved. On the other hand, in the present exemplary embodiment, by providing the second part 21*b*, the first part 21*a* receives the force in both of the width direction (Z axis direction) and the thickness direction (X axis direction), and is returned to the original state from the bent and twisted state over the entire length (that is, up to the vicinity of the discharge port 14*h* of the upper recovery chamber 14*a*, for example), and thus, it is possible to considerably enhance the effect of collapsing clogging of the remaining developer.

Further, there is a configuration in which the remaining developer is transported while being collapsed using a paddle or the like, as another configuration for prevention of clogging of the remaining developer, but the cost of the image forming apparatus becomes high due to the paddle or the like. On the other hand, in the present exemplary embodiment, since the transport assisting member 21 that is cheaper is used with a simple structure, it is possible to reduce the cost of the image forming apparatus while providing a high clogging prevention function.

Further, in the present exemplary embodiment, as shown in FIGS. 9 to 14, a cut section 21*c* that extends downward in a boundary (intersection) between the first part 21*a* and the upper portion of the second part 21*b* is formed in the transport assisting member 21.

If the cut section 21*c* is not present, the deformation (bending) movement of the first part 21*a* is suppressed in the second part 21*b*, and a free movement of the second part 21*b* is also suppressed. Accordingly, the first part 21*a* and the second part 21*b* have simple resilience, and thus, the effect of collapsing the remaining developer in the guide tube 20 is reduced.

On the other hand, in the present exemplary embodiment, by forming the cut section 21*c* in the transport assisting member 21, the deformation movement of the first part 21*a* is not suppressed in the second part 21*b*, and the free movement portion of the second part 21*b* also increases. Thus, the deformation movement of the transport assisting member 21 becomes large and complicated, and it is thus possible to more effectively collapse the remaining developer in the guide tube 20.

Further, the second part 21*b* in the present exemplary embodiment is formed so that the height thereof at a first position that is the most distant from the first part 21*a* is lower than the height thereof at a second position that is the closest to the first part 21*a*, and the height thereof at a position between the first position and the second position is higher than the height thereof at the first position and is lower than the height thereof at the second position. Specifically, a slope 21*ba* is formed in an upper portion of the second part 21*b* so that the slope 21*ba* is low in height as it is distant from the first part 21*a*.

If a corner remains on the outer side of the upper portion of the second part 21*b*, when the second part 21*b* moves upward, the corner on the outer side of the upper portion of the second part 21*b* is in contact with an inner wall of the guide tube 20 to suppress the up movement of the second part 21*b*, thereby obstructing the deformation movement of the first part 21*a*. Thus, the effect of collapsing the remaining developer in the guide tube 20 is reduced.

On the other hand, in the present exemplary embodiment, by forming the slope 21*ba* in the upper portion of the second part 21*b* to remove the corner on the outer side of the upper portion of the second part 21*b*, the second part 21*b* moves to a higher position, and thus, larger deformation of the first part 21*a* is achieved. Thus, it is possible to more effectively collapse the remaining developer in the guide tube 20.

Here, the structure is not limited to the slope shape as long as the shape of the upper portion of the second part 21*b* is a shape that does not suppress the deformation movement of the first part 21*a*. For example, a portion corresponding to the corner on the outer side of the upper portion of the second part 21*b* may have a stepwise shape.

Further, in the present exemplary embodiment, as shown in FIGS. 12 and 13, an intersection angle θ between the first part 21*a* and the second part 21*b* in the transport assisting member 21 is set to 90° to 150°, for example. Here, in order to prevent clogging due to the remaining developer, the intersection angle θ is preferably set to 90°. However, if the intersection angle θ is set to 90°, a periodic sound generated when the second part 21*b* is in contact with the spiral blade 14*eb* of the transport member 14*e* and then moves resiliently may be loud. In this case, it is preferable that the intersection angle θ be larger than 90°. Thus, the periodic sound generated when the second part 21*b* moves resiliently from the spiral blade 14*eb* of the transport member 14*e* becomes small. The soft sound effect is increased as the intersection angle θ is large.

Further, in the present exemplary embodiment, as shown in FIGS. 5 and 6, and FIGS. 8 to 14, plural cut sections 21*d* that extend upward from respective lower ends in the lower portions of being in contact with the transport member 14*e* in the first part 21*a* and the second part 21*b* in the transport assisting member 21 are formed.

In a case where the cut sections 21*d* are not present, a great effect of collapsing the remaining developer in the guide tube 20, but there is a case in which the periodic sound generated when the transport assisting member 21 moves resiliently from the spiral blade 14*eb* of the transport member 14*e* becomes loud.

On the other hand, in the present exemplary embodiment, by forming the cut sections 21*d* in the lower portions of the first part 21*a* and the second part 21*b*, stiffness of the first part 21*a* and the second part 21*b* is decreased, and thus, the periodic sound generated when the transport assisting member 21 moves resiliently from the spiral blade 14*eb* of the transport member 14*e* becomes small.

Here, the cut section 21*d* may be formed in any one of the first part 21*a* and the second part 21*b*. Further, the number of the cut sections 21*d* may be one. However, as the number of the cut sections 21*d* is large, the soft sound effect is enhanced. Here, if the number of the cut sections 21*d* is increased (if the adjacent pitch of the cut sections 21*d* is narrowed), there is a problem in the effect of collapsing the remaining developer and durability.

Thus, in the present exemplary embodiment, the number of the cut sections 21*d* and the interval between the adjacent cut sections 21*d* are set so as to solve such a problem. Here, for example, three cut sections 21*d* are formed in the first part 21*a* and two cut sections 21*d* are formed in the second part 21*b*. Accordingly, it is possible to achieve a high soft sound effect while maintaining the effect of collapsing the remaining developer in the guide tube 20 and the durability.

Further, in the present exemplary embodiment, as shown in FIGS. 5 and 6 and FIGS. 8 to 14, at the tip end of the cut section 21*d*, a round hole 21*e* having a diameter larger than the width of the cut section 21*d* is formed. Thus, stress applied to the tip end of the cut section 21*d* is dispersed, and thus, extension of cutting is suppressed from the tip end of the cut section 21*d*.

Next, an operation example of the transport assisting member 21 will be described with reference to FIGS. 15A to 15D. FIGS. 15A to 15D are schematic diagrams illustrating movement transition states of the transport assisting member 21, when seen from the side of the front (one end surface) of the image forming apparatus.

Figure 15A:
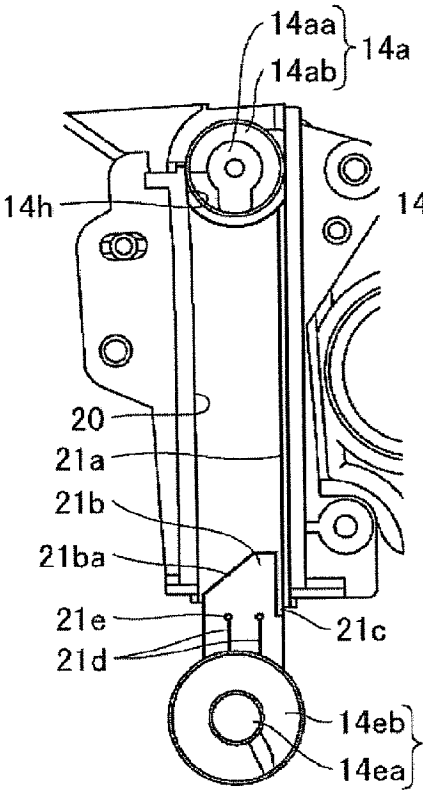
FIGS. 15A to 15D are schematic diagrams illustrating movement transition states of the transfer assisting member, when seen from the side of the front (one end surface) of the image forming apparatus in FIG. 1.

First, as shown in FIG. 15A, the spiral blade 14*eb* is in contact with the first part 21*a* and the second part 21*b* of the transport assisting member 21 by rotation of the lower transport member 14*e*. Thus, the first part 21*a* and the second part 21*b* receive a force in the rotating axis direction (Z axis direction).

Figure 15B:
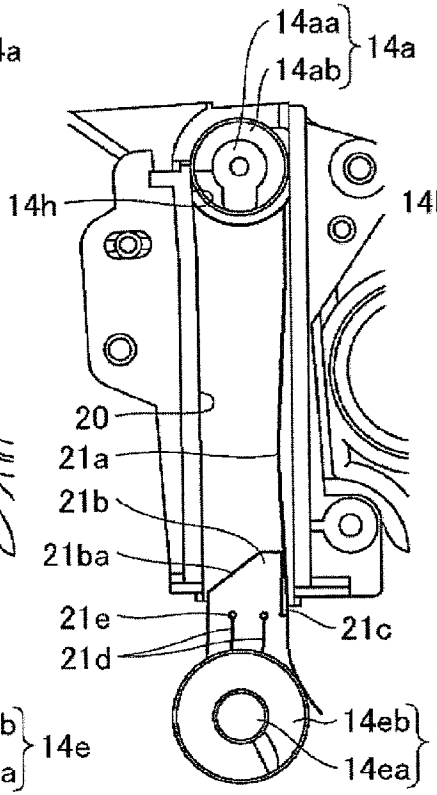

Subsequently, if the rotation of the transport member 14*e* proceeds, as shown in FIG. 15B, the first part 21*a* and the second part 21*b* are pressed from the spiral blade 14*eb* of the transport member 14*e*, and the rear surface of the first part 21*a* starts to be separated from the inner wall surface of the guide tube 20, and thus, the first part 21*a* starts to be bent.

Figure 15C:
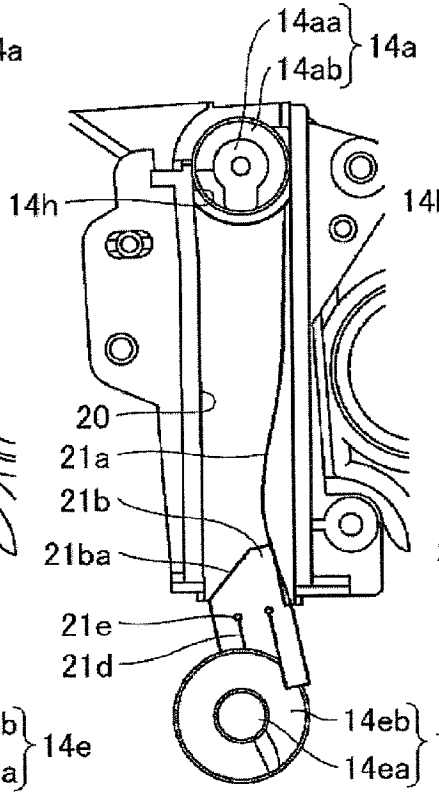

Subsequently, if the rotation of the transport member 14*e* proceeds, as shown in FIG. 15C, the second part 21*b* is gradually lifted upward while being pressed and inclined from the spiral blade 14*eb* of the transport member 14*e*. Then, the first part 21*a* is also lifted in conjunction with the up movement of the second part 21*b*, and thus, bending of the first part 21*a* becomes large.

Here, if the cut section 21*c* is not present at the boundary between the first part 21*a* and the second part 21*b*, the first part 21*a* is not bent well by being interrupted by the second part 21*b*. On the other hand, in the present exemplary embodiment, since the bending of the first part 21*a* is not interrupted by the second part 21*b* by providing the cut section 21*c*, the bending of the first part 21*a* becomes large. Further, the free movement region of the second part 21*b* becomes also large.

Figure 15D:
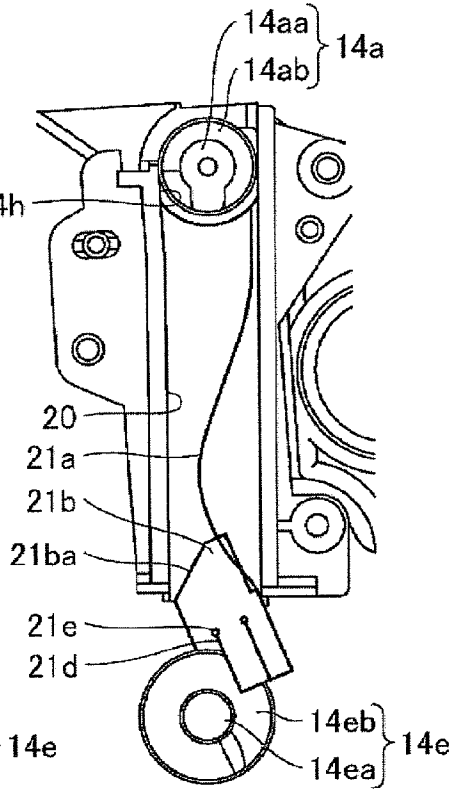

Subsequently, if the rotation of the transport member 14*e* further proceeds, as shown in FIG. 15D, the second part 21*b* is further lifted upward while being inclined. Thus, the first part 21*a* is twisted while being bent over the entire length.

Here, if the corner remains on the outer side of the upper portion of the second part 21*b*, since the corner is in contact with the inner wall of the guide tube 20, the up movement of the second part 21*b* is interrupted. On the other hand, in the present exemplary embodiment, since the corner on the outer side of the upper portion of the second part 21*b* is removed, the up movement of the second part 21*b* increases as much as that, and thus, the bending of the first part 21*a* becomes large.

Subsequently, if the rotation of the transport member 14*e* proceeds, since the spiral blade 14*eb* of the transport member 14*e* is deviated from the first part 21*a* and the second part 21*b*, the first part 21*a* and the second part 21*b* are returned to the original shape while being resiliently vibrated.

Here, when the first part 21*a* and the second part 21*b* are deviated from the spiral blade 14*eb* of the transport member 14*e*, the widthwise direction entire of each of the first part 21*a* and the second part 21*b* does not move resiliently at once, but moves resiliently for each part divided by the cut section 21*d* of the first part 21*a* and the second part 21*b*. Thus, the periodic sound generated when the transport assisting member 21 moves resiliently becomes small.

The remaining developer in the guide tube 20 is collapsed through the above-mentioned deformation and restoration movement of the transport assisting member 21 to prevent clogging. Even in the case of the transport assisting member without the cut section 21*d*, the first part 21*a* and the second part 21*b* are operated in the same way as described above, except for the movement relating to the soft sound.

Figure 16:
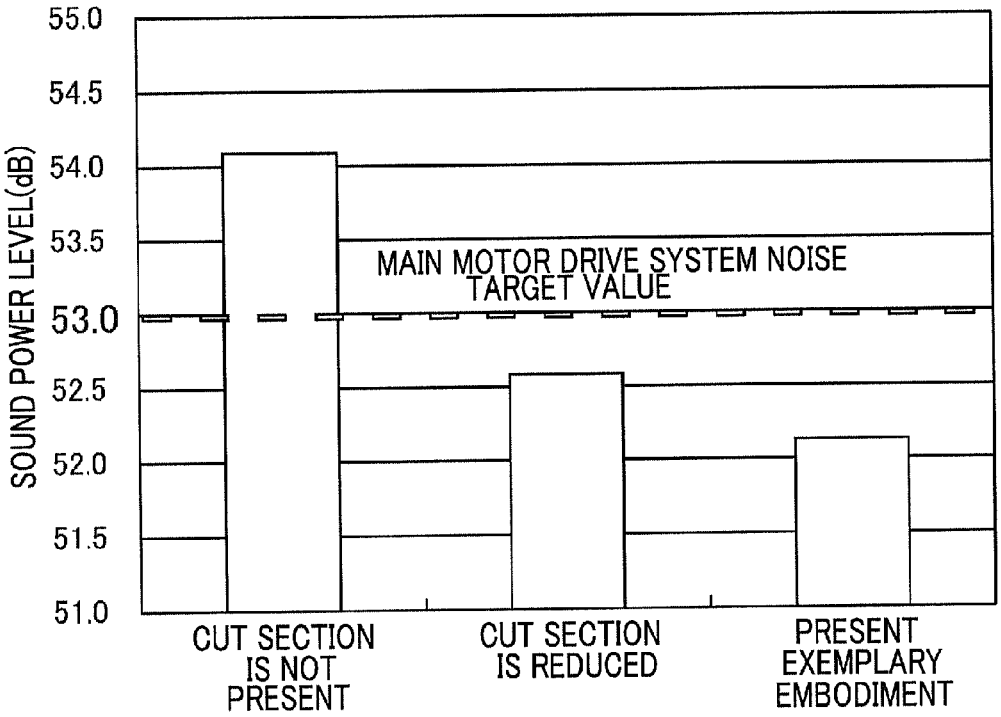
FIG. 16 is a graph illustrating measurement results of generated sound in a case where a cut section is not formed in a lower portion of the transport assisting member and in a case where the number of cut sections is changed.

Next, FIG. 16 is a graph illustrating measurement results of sound generated in a case where the cut section 21*d* is not formed in the lower portion of the transport assisting member 21 and in a case where the number of the cut sections 21*d* is changed. A central broken line is not particularly limited, and represents a predetermined noise target value.

The leftmost case represents a measurement result in a case where the cut section 21*d* is not present in the lower portion of the transport assisting member 21, the rightmost case represents a measurement result in the transport assisting member 21 described in the present exemplary embodiment, and the central case represents a measurement result in a case where the number of the cut sections 21*d* is reduced compared with the case of the present exemplary embodiment.

In a case where the cut section 21*d* is not formed, prevention of clogging of the remaining developer and security of durability of the transport assisting member 21 are favorable compared with the other cases, but there is a case where the sound power level exceeds the noise target value. On the other hand, in a case where the cut section 21*d* is formed in the lower portion of the transport assisting member 21 as in the present exemplary embodiment, it may be understood that a high soft sound effect is obtained below the noise target value.

Figure 17:
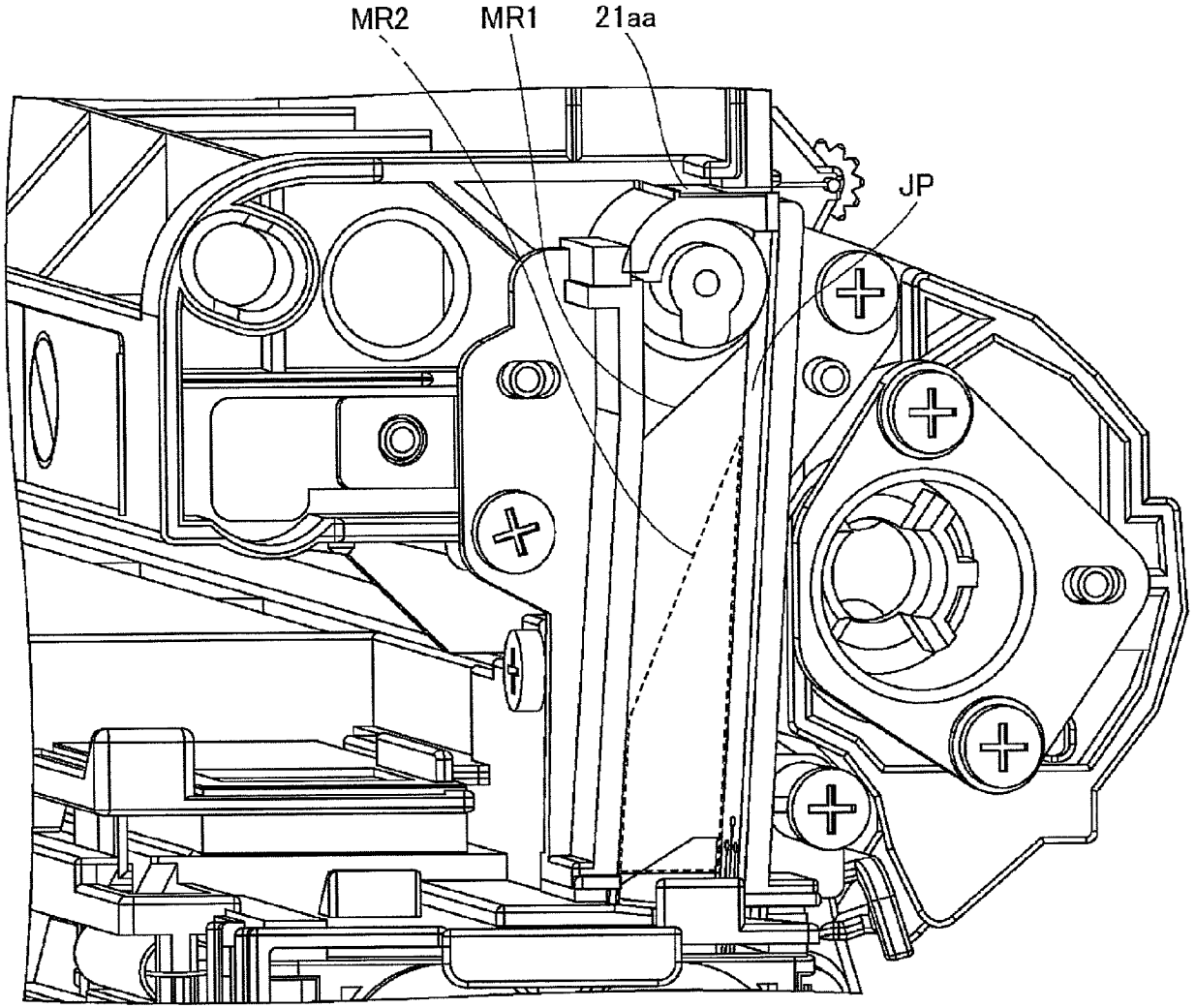
FIG. 17 is an enlarged perspective view illustrating the main parts of the image forming body in FIG. 3.
Figure 18:
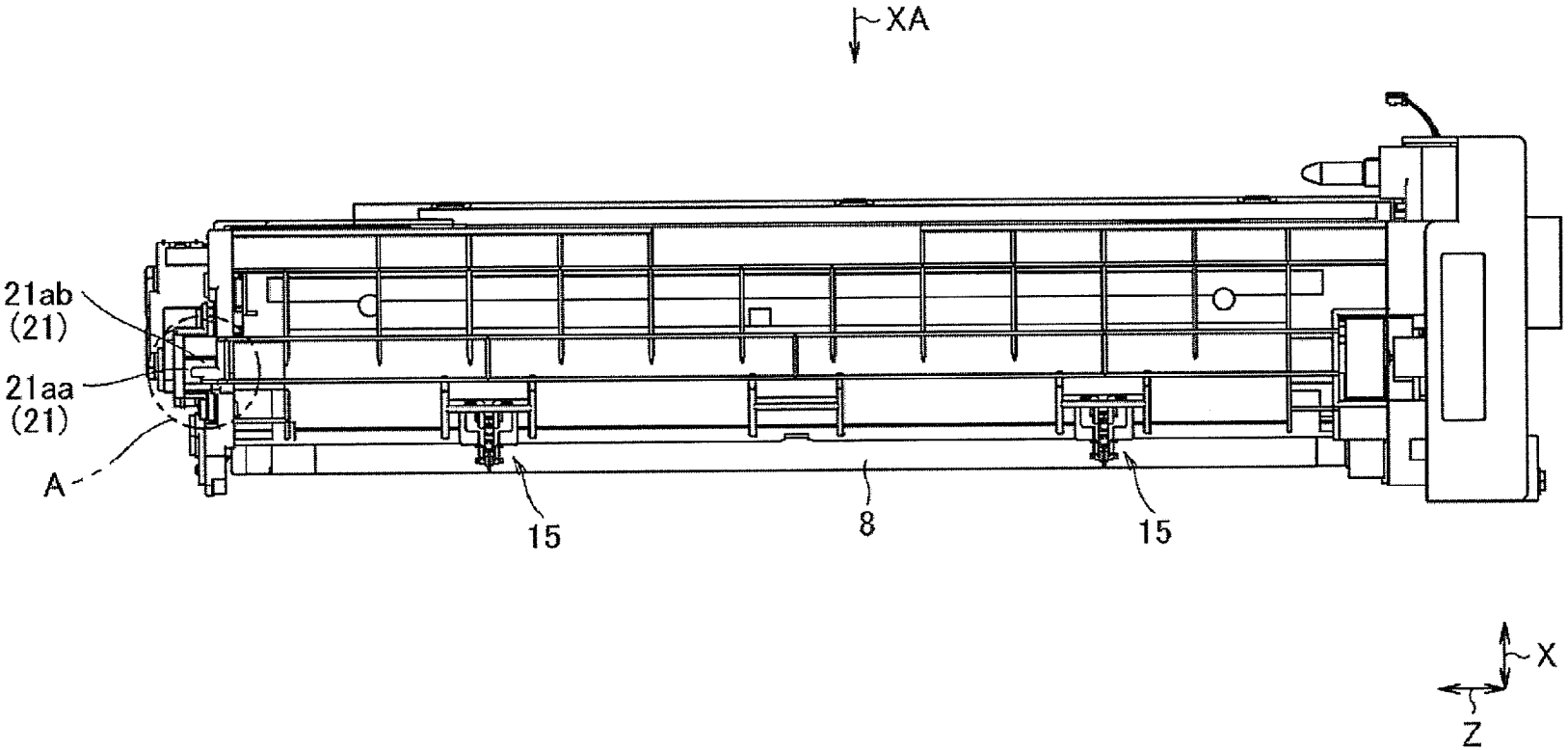
FIG. 18 is a top view illustrating the image forming body in FIG. 3.
Figure 19:
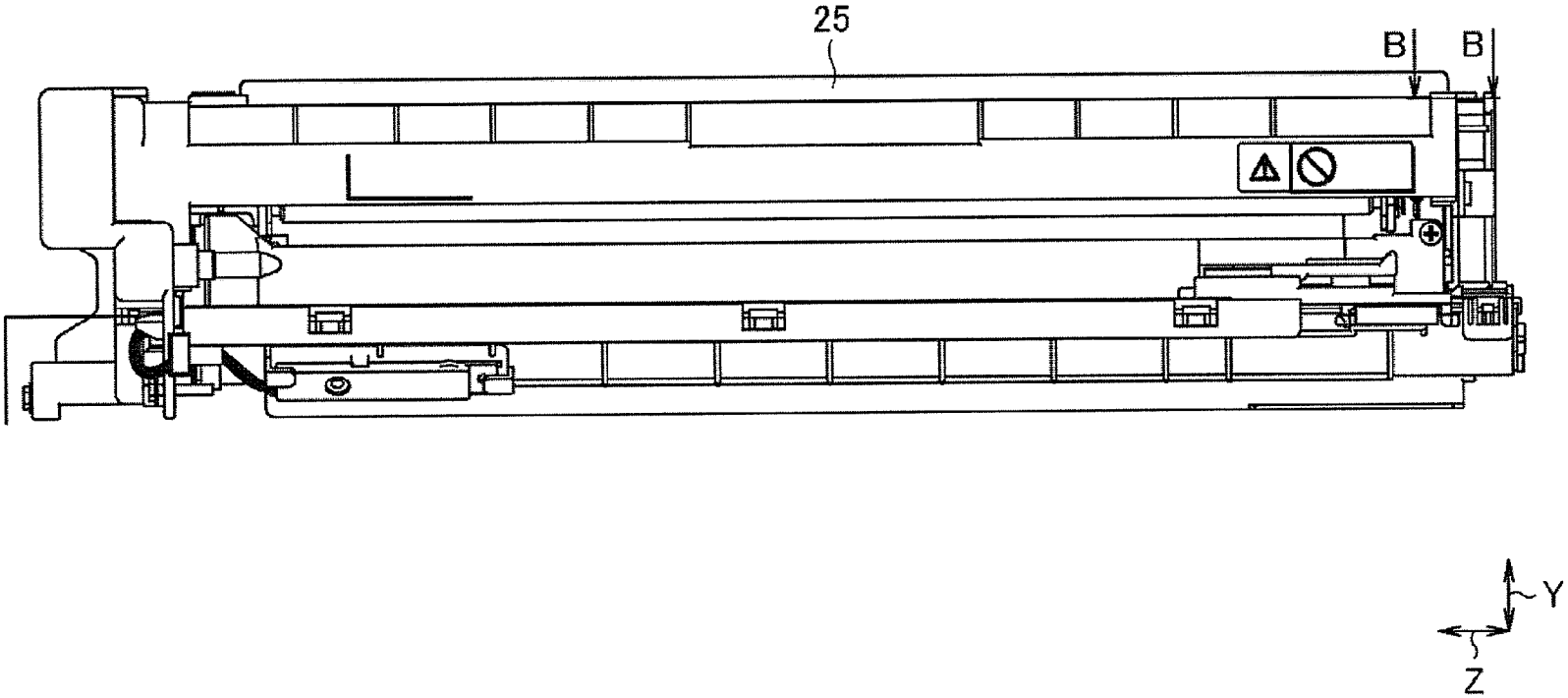
FIG. 19 is a side view illustrating the image forming body in FIG. 18, when seen in an arrow direction XA.
Figure 20:
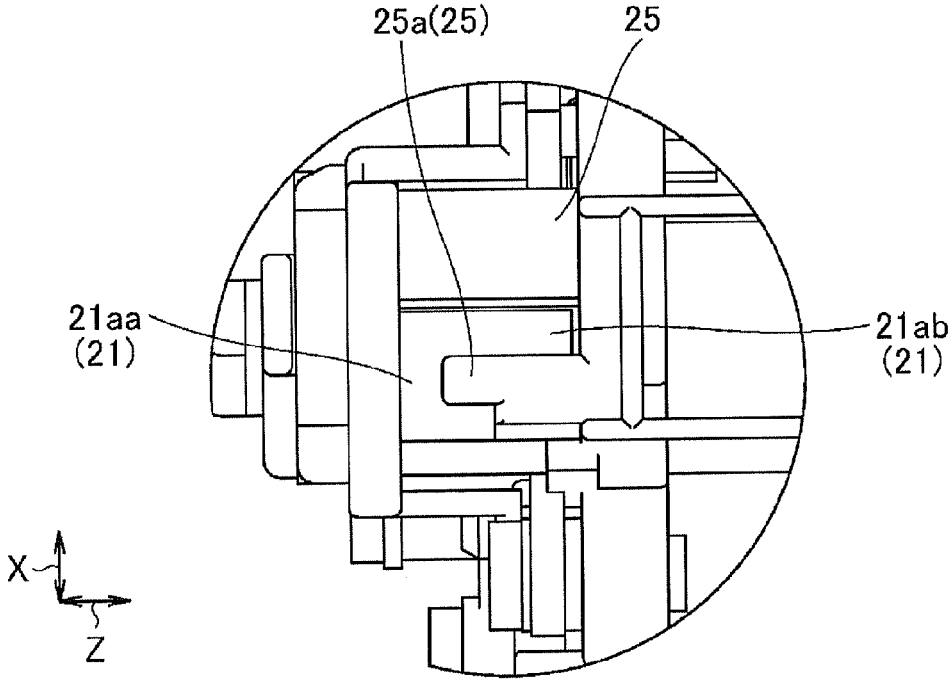
FIG. 20 is an enlarged plan view illustrating a region A in FIG. 18.
Figure 21:
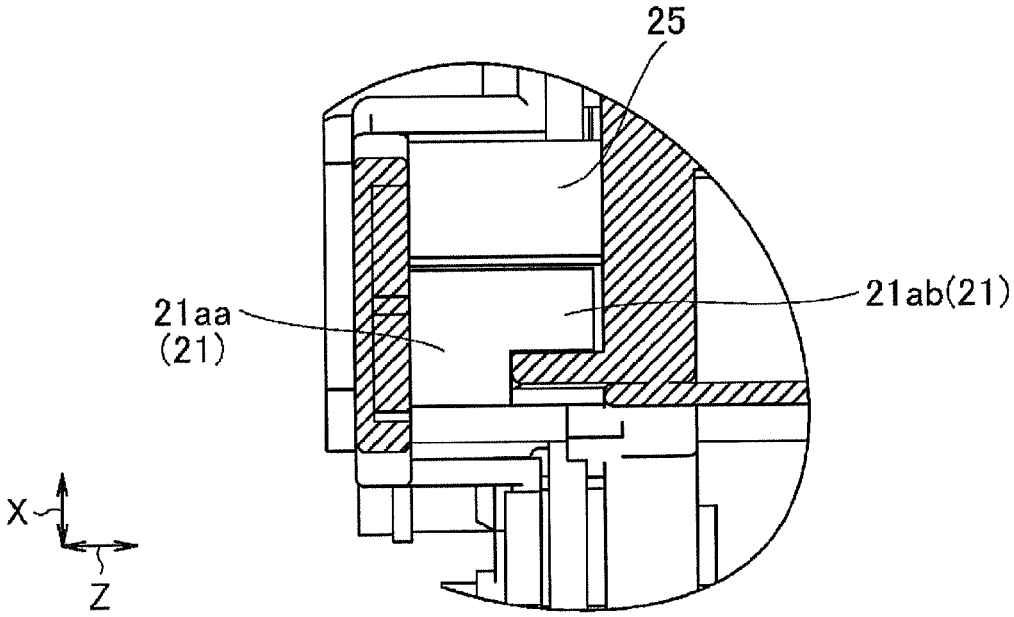
FIG. 21 is a cross-sectional view taken along line B-B in FIG. 19.

Next, a configuration in which the above-mentioned transport assisting member 21 is fixed will be described with reference to FIGS. 4 to 6, and FIGS. 17 to 23. FIG. 17 is an enlarged perspective view illustrating the main parts of the image forming body in FIG. 3, FIG. 18 is a top view illustrating the image forming body in FIG. 3, FIG. 19 is a side view illustrating the image forming body in FIG. 18, when seen in an arrow direction XA, FIG. 20 is an enlarged plan view illustrating a region A in FIG. 18, and FIG. 21 is a cross-sectional view taken along line B-B in FIG. 19. In FIGS. 18, 20 and 21, the X axis and Z axis are illustrated, and in FIG. 19, the Y axis and Z axis are illustrated.

In the present exemplary embodiment, as shown in FIGS. 4 to 6, the upper portion 21*aa* of the first part 21*a* of the transport assisting member 21 is disposed outside the guiding tube 20. The upper portion 21*aa* is folded and is fixed to the casing 25 by a double sided tape for attachment (not shown) or the like.

In a case where a part of the transport assisting member 21 is attached and fixed to the inside of the guiding tube 20, for example, the following trouble is caused. That is, the movement range of the transport assisting member 21 may decrease, and the collaping effect of the remaining developer may not be sufficiently achieved. Further, if the transport assisting member 21 stays in the guide tube 20 due to damage or the like of the attached part of the transport assisting member 21, the collapsing effect of the remaining developer may not be achieved, and the guide tube 20 may be narrowed to reduce transport efficiency of the remaining developer and to cause clogging. Further, since the guide tube 20 generally has a narrow cylindrical shape, it is difficult to attach the transport assisting member 21. Accordingly, the manufacturing cost increases, and the transport assisting member 21 may be detached due to poor work. Further, the guide tube 20 forms a closed space and may not be visually confirmed, and thus, it is difficult to perform inspection after assembly. Thus, it is necessary to add a confirmation and inspection process during assembly, which results in increase in inspection man-hour and increase in cost.

On the other hand, in the present exemplary embodiment, by fixing the transport assisting member 21 to the outside of the guide tube 20, as shown in FIG. 17, the movement range (solid line) of the transport assisting member 21 is wider than a movement range (broken line) MR2 in a case where the transport assisting member 21 is fixed at a position JP in the guide tube 20. Thus, the collapsing effect of the remaining developer in the guide tube 20 is enhanced.

Further, even though the attached part of the transport assisting member 21 is detached, the attached part is not inserted into the guide tube 20, and thus, the reduction in transport efficiency of the remaining developer and the occurrence of clogging do not occur.

Further, since the attached part of the transport assisting member 21 is disposed outside the guide tube 20, the attachment work is easy, and the manufacturing cost is reduced. Further, the occurrence of poor work is reduced.

Further, since the attached part of the transport assisting member 21 is disposed outside the guide tube 20, it is easy to perform confirmation after the assembly process, and thus, it is not necessary to add the confirmation inspection process during the assembly, thereby reducing the inspection cost.

Further, in the present exemplary embodiment, as shown in FIGS. 4 to 6, FIGS. 18, 20 and 21, the tip end of the upper portion 21*aa* of the transport assisting member 21 is folded in an L shape, and a bending section (an example of an engaging section) 21*ab* is engaged with apart of the casing 25. Further, a hood section 25*a* (see FIG. 20) that covers apart of the upper portion 21*aa* of the transport assisting member 21 from above is also formed in a part of the casing 25.

Thus, even though the double sided tape for attachment used for fixing the transport assisting member 21 is peeled off, the bending section 21*ab* of the upper portion 21*aa* of the transport assisting member 21 is engaged with the casing 25 to thereby reliably hold the transport assisting member 21. Thus, the reduction in transport efficiency of the remaining developer in the guide tube 20 and the occurrence of clogging do not occur.

Further, if a corner portion at which the upper portion 21*aa* of the transport assisting member 21 and the bending section 21*ab* intersect with each other is matched with the part of the casing 25, the transport assisting member 21 is set to be mounted with good alignment in the guide tube 20. Thus, alignment of the transport assisting member 21 during the assembly process becomes easy, and the assembly process is simplified.

Here, the shape of the upper portion 21*aa* of the transport assisting member 21 is not limited to the L shape, and for example, may be a T shape. Further, by forming one, two or more round holes (an example of the engaging section) in the upper portion 21*aa* of the transport assisting member 21 and by fitting a protrusion of the casing 25 into the round hole, the transport assisting member 21 may be held.

Figure 22:
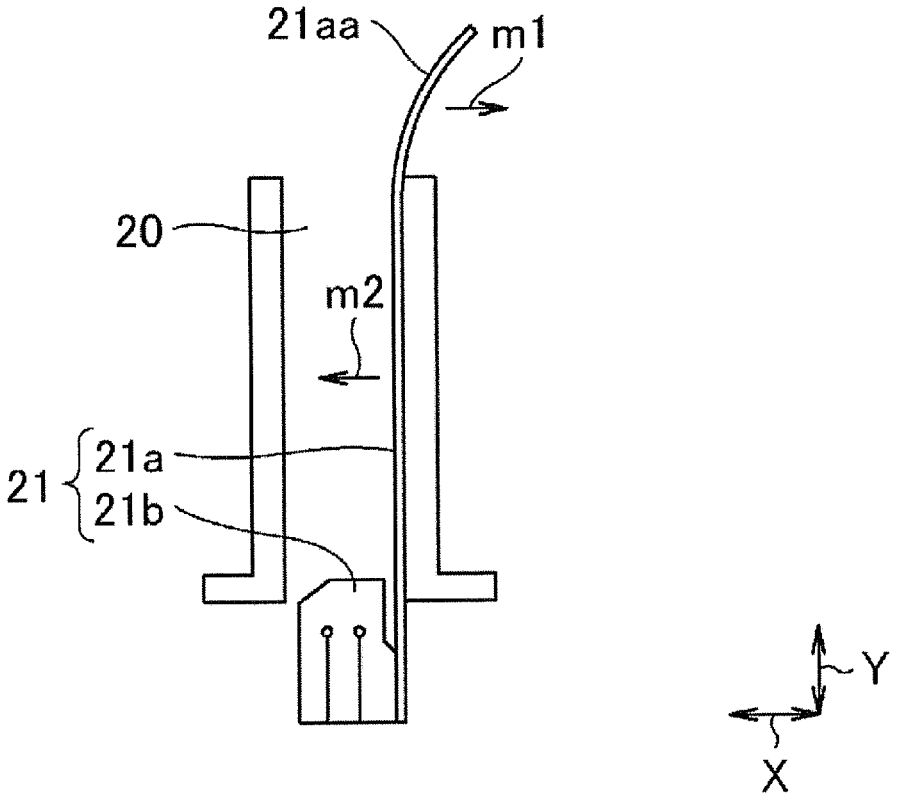
FIG. 22 is a diagram illustrating a folding direction of an upper portion of the transport assisting member.
Figure 23:
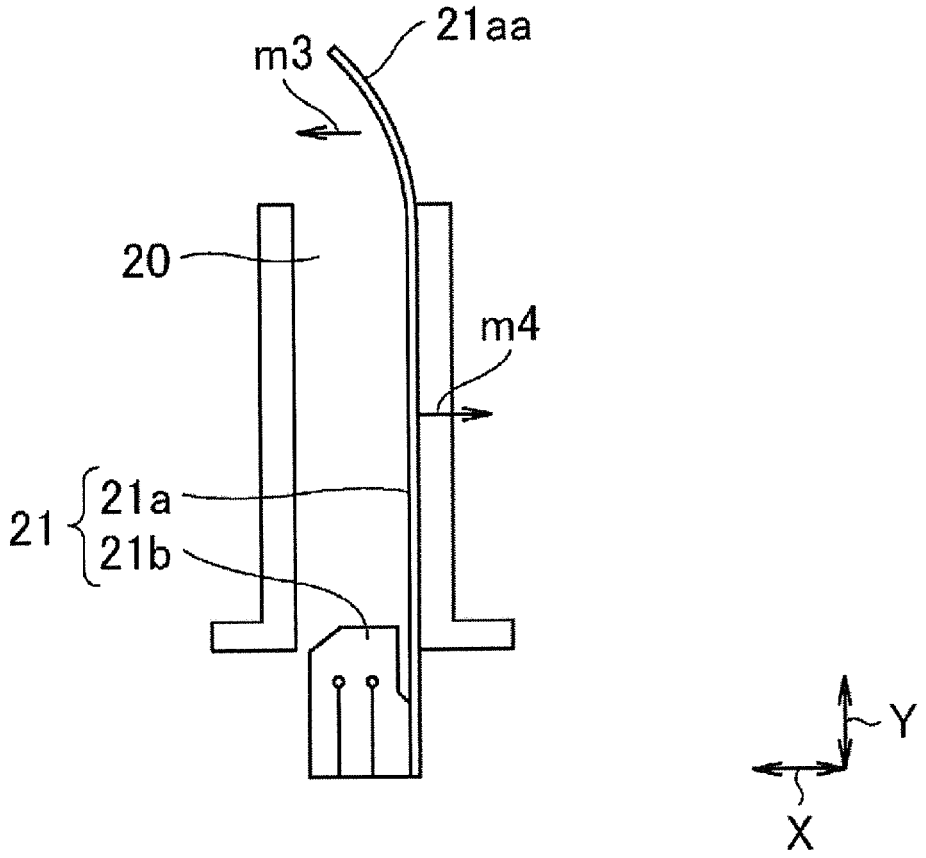
FIG. 23 is a diagram illustrating a folding direction of the upper portion of the transport assisting member.

Further, in the present exemplary embodiment, as shown in FIG. 6, for example, the upper portion 21*aa* of the transport assisting member 21 is folded toward the front surface side of the transport assisting member 21 to be attached to the casing 25. The reason will be described with reference to FIGS. 22 and 23. FIGS. 22 and 23 are diagrams illustrating a folding direction of the upper portion of the transport assisting member 21. In FIGS. 22 and 23, the Y axis and X axis are illustrated.

First, as shown in an arrow m1 in FIG. 22, if the upper portion 21*aa* of the transport assisting member 21 is folded toward the rear surface side of the transport assisting member 21, a force is applied to the transport assisting member 21 in the guide tube 20, as indicated by an arrow m2, in a direction of being separated from the inner wall of the guide tube 20, and thus, the guide tube 20 is closed.

On the other hand, in the present exemplary embodiment, as shown in an arrow m3 in FIG. 23, by folding the upper portion 21*aa* of the transport assisting member 21 toward the front surface side of the transport assisting member 21, a force is applied to the transport assisting member 21 in the guide tube 20, as indicated by an arrow m4, in a direction of being pressed against the inner wall surface of the guiding tube 20, and thus, the guide tube 20 is not closed. Thus, a hollow transport path of the remaining developer in the guide tube 20 is secured, and thus, the remaining developer in the guide tube 20 favorably drops.

The invention made by the present inventors has been described with reference to the exemplary embodiments, but the exemplary embodiments disclosed in this specification are only examples in all aspects, and are not limited to the disclosed technique. That is, the technical scope of the invention should not be construed in a limitative manner on the basis of the description in the exemplary embodiments, but should be construed according to the disclosure of claims and includes techniques equivalent to the disclosure of claims and all modifications in a range without departing from the spirit of claims.

For example, in the exemplary embodiments, a case where the invention is applied to the image forming apparatus of the direct transfer type in which the developer image on the photoconductor drum is transferred to the sheet by the transfer roller has been described, but the invention is not limited thereto but may be applied to an image forming apparatus of an intermediate transfer type in which a developer image formed on an intermediate transfer belt (an example of an image holding member) is transferred to a sheet by a secondary transfer roller. In this case, in a developer transport device that removes and recovers a remaining developer on the intermediate transfer belt by a cleaning member provided at an intermediate position of the intermediate transfer belt and transports the remaining developer to a developer discarding container, the above-mentioned transport assisting member 21 is provided in the transport path of the developer.

Further, in the exemplary embodiments, a case where the transport members 14*a*, 14*e* and 14*f* that include the spiral blade are used as the transport means has been described, but the invention is not limited thereto. For example, a transport member of a coil spring shape may be used.

In the above description, as the recording medium transported in the image forming apparatus according to the invention, for example, various things on which an image may be formed, such as a film or a postcard, may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer transport device comprising:

a recovery chamber where a developer from an image holding member after transfer is recovered;

an accommodation chamber that is disposed under the recovery chamber and accommodates the developer;

a transport unit that transports the developer into the accommodation chamber by rotation;

a hollow guiding path that is formed in a hollow shape to connect a discharge port of the recovery chamber and an accommodation port of the accommodation chamber to guide the developer in the recovery chamber into the accommodation chamber; and a transport assisting member that is disposed inside the hollow guiding path and is deformed and restored by rotation of the transport unit to assist transport of the developer inside the hollow guiding path, wherein the transport assisting member includes a first part that extends along an inner wall surface of the hollow guiding path from the side of the discharge port of the recovery chamber to a position where the first part is in contact with the transport unit, and a second part that is disposed to intersect with a front surface of the first part extending along the inner wall surface of the hollow guiding path and extends from an intermediate position of the first part in a length direction to a position where the second part is in contact with the transport unit.

2. The developer transport device according to claim 1, wherein a cut section is formed to extend downward at an intersection between the first part and an upper portion of the second part.

3. The developer transport device according to claim 1, wherein the second part is formed so that the height of a first position that is most distant from the first part is lower than the height of a second position that is closest to the first part, and so that the height of a position between the first position and the second position is higher than the height of the first position and is lower than the height of the second position.

4. The developer transport device according to claim 2, wherein the second part is formed so that the height of a first position that is most distant from the first part is lower than the height of a second position that is closest to the first part, and so that the height of a position between the first position and the second position is higher than the height of the first position and is lower than the height of the second position.

5. The developer transport device according to claim 1, wherein an intersection angle between the first part and the second part is 90° or greater.

6. The developer transport device according to claim 2, wherein an intersection angle between the first part and the second part is 90° or greater.

7. The developer transport device according to claim 3, wherein an intersection angle between the first part and the second part is 90° or greater.

8. The developer transport device according to claim 4, wherein an intersection angle between the first part and the second part is 90° or greater.

9. The developer transport device according to claim 1, wherein one cut section or two or more cut sections are formed to extend upward from a lower end in a lower portion in the first part, the second part or both of the first part and the second part that are in contact with the transport unit.

10. The developer transport device according to claim 2, wherein one cut section or two or more cut sections are formed to extend upward from a lower end in a lower portion in the first part, the second part or both of the first part and the second part that are in contact with the transport unit.

11. The developer transport device according to claim 3, wherein one cut section or two or more cut sections are formed to extend upward from a lower end in a lower portion in the first part, the second part or both of the first part and the second part that are in contact with the transport unit.

12. The developer transport device according to claim 4, wherein one cut section or two or more cut sections are formed to extend upward from a lower end in a lower portion in the first part, the second part or both of the first part and the second part that are in contact with the transport unit.

13. The developer transport device according to claim 5, wherein one cut section or two or more cut sections are formed to extend upward from a lower end in a lower portion in the first part, the second part or both of the first part and the second part that are in contact with the transport unit.

14. The developer transport device according to claim 6, wherein one cut section or two or more cut sections are formed to extend upward from a lower end in a lower portion in the first part, the second part or both of the first part and the second part that are in contact with the transport unit.

15. The developer transport device according to claim 7, wherein one cut section or two or more cut sections are formed to extend upward from a lower end in a lower portion in the first part, the second part or both of the first part and the second part that are in contact with the transport unit.

16. The developer transport device according to claim 8, wherein one cut section or two or more cut sections are formed to extend upward from a lower end in a lower portion in the first part, the second part or both of the first part and the second part that are in contact with the transport unit.

17. The developer transport device according to claim 9, wherein a round hole having a diameter larger than the width of the cut section is formed at a tip end of the cut section that extends upward from each lower end in the first part, the second part or both of the first part and the second part.

18. The developer transport device according to claim 10, wherein a round hole having a diameter larger than the width of the cut section is formed at a tip end of the cut section that extends upward from each lower end in the first part, the second part or both of the first part and the second part.

19. An image forming apparatus comprising:

a developing unit that supplies a developer to an image holding member to develop an image;

a transfer unit that transfers a developer image on the image holding member to a transfer target;

a cleaning unit that cleans the developer that remains on the image holding member after transfer of the transfer unit; and the developer transport unit that transports the developer recovered by the cleaning unit, according to claim 1.

20. An image forming apparatus comprising:

a developing unit that supplies a developer to an image holding member to develop an image;

a transfer unit that transfers a developer image on the image holding member to a transfer target;

a cleaning unit that cleans the developer that remains on the image holding member after transfer of the transfer unit; and the developer transport unit that transports the developer recovered by the cleaning unit, according to claim 2.

* * * * *